US005865126A

United States Patent [19]

Miranda

[11] Patent Number: 5,865,126

[45] Date of Patent: Feb. 2, 1999

[54] ADJUSTABLE EXPANSIBLE INTERLOCKING MODULAR STRUCTURAL SYSTEM AND METHOD

[76] Inventor: Pedro A. Miranda, 114 Rubi Street, Golden Gate, Guaynabo, Puerto Rico, 00968

[21] Appl. No.: 949,932

[22] Filed: Oct. 14, 1997

[51] Int. Cl.[6] ..... A47B 7/00

[52] U.S. Cl. ..... 108/91; 108/180

[58] Field of Search ..... 108/91, 53.1, 180, 108/102; 211/188, 194, 49.1, 59.4

[56] References Cited

U.S. PATENT DOCUMENTS

| | | | |
|---|---|---|---|
| 3,695,190 | 10/1972 | Bucholz | 108/91 |
| 3,756,581 | 9/1973 | Albertini | 211/194 X |
| 3,888,353 | 6/1975 | Leifheit | 108/91 X |
| 4,184,599 | 1/1980 | Drake et al. | 211/188 X |
| 5,141,117 | 8/1992 | Olsen et al. | 211/194 X |
| 5,452,811 | 9/1995 | Taravella et al. | 211/188 X |

*Primary Examiner*—José V. Chen
*Attorney, Agent, or Firm*—Donald W. Meeker

[57] ABSTRACT

Interlocking modular elements are each formed by two side panels spaced apart in parallel face-to-face alignment sandwiching two protruding elongated elements spaced apart in planar alignment forming a slot therebetween. A series of interlocking modular elements stacked vertically in an alternating orthogonal array interlock with slots intersecting adjacent slots and panels to form an vertical structural support. In a preferred embodiment, the space between elongated elements is equal to the width of one elongated element. Each protrusion of each elongated element creates a tenon insertable in each mortice between elongated elements to form a coplanar vertical structural support. Alternately, second modular elements are formed with two spaced parallel side panels sandwiching a single elongated element protruding above and below the side panels. Horizontal slots are formed between side panels. First horizontal elements formed of a single rigid member slide into the horizontal slots and edge slots engage the side panels to lock them in. Second horizontal elements are each formed by two spaced apart planar aligned planks interconnected by a shorter plank leaving a slot at each end to engage orthogonally stacked modular elements. Sliding drawer-like storage elements may also be supported in the slots. Tie members interconnect vertical structural supports. A series of paired vertical structural supports with horizontal elements therebetween may be stretched out in one plane and in orthogonal planes. An adjustable brace element having at least one diagonal component connects between the top and bottom of the structure.

21 Claims, 14 Drawing Sheets

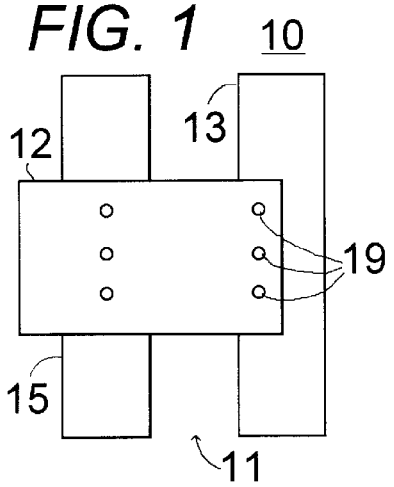
FIG. 1
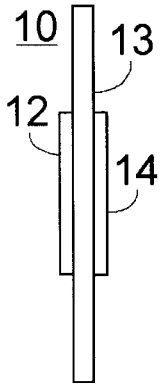
FIG. 2
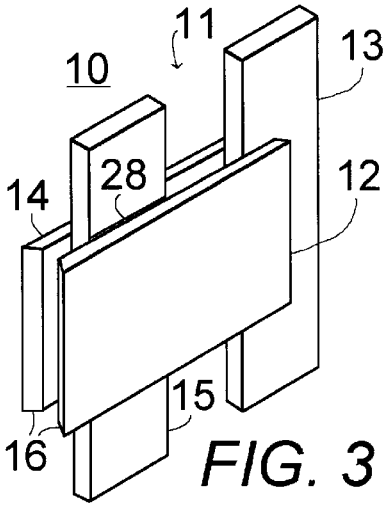
FIG. 3
FIG. 8
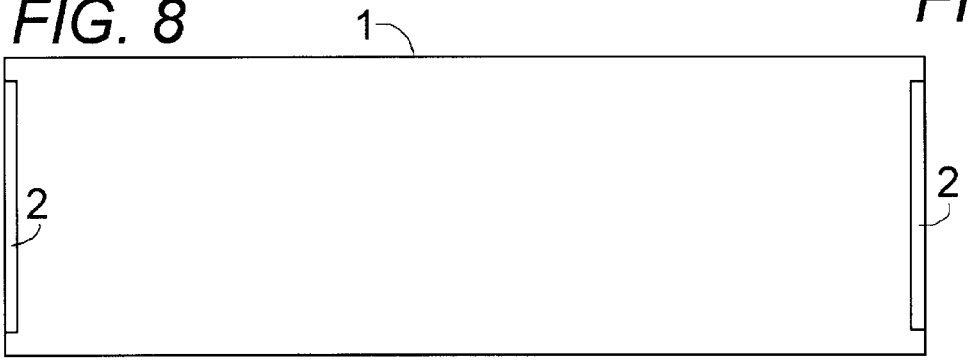
FIG. 9
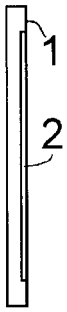
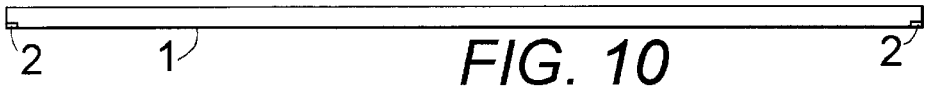
FIG. 10
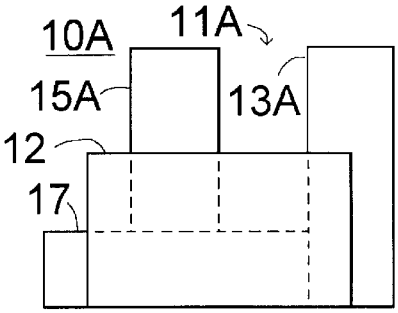
FIG. 13
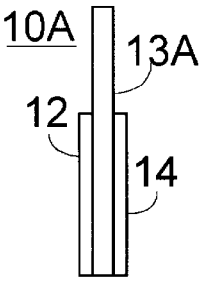
FIG. 14
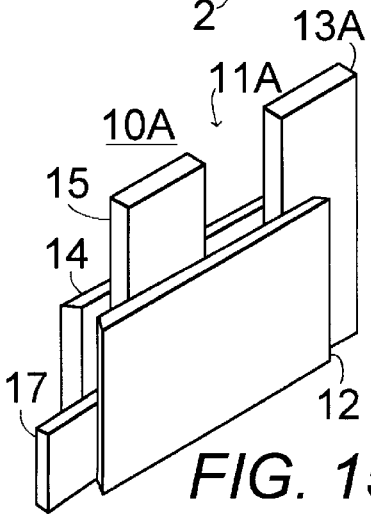
FIG. 15

ADJUSTABLE EXPANSIBLE INTERLOCKING MODULAR STRUCTURAL SYSTEM AND METHOD

BACKGROUND OF THE INVENTION

1. Technical field

The present invention relates to structural support systems, and in particular, to an adjustable expansible modular support system which requires no fasteners or tools for assembly and which is easily fabricated from uniform straight-cut stock and the method for making and using the modular support system.

2. Description of the Prior Art

Assembling structures generally requires fasteners applied in the assembly process to hold the structures together. Installing the fasteners requires considerable cost, time, and effort in addition to handling the structural elements themselves, and tools are normally required to install the fasteners.

Structural elements for any given structure are usually fabricated from a wide variety of sizes and shapes of stock necessitating the planning, ordering, handling, and stocking of such a variety with the inherent time and costs involved.

Many structures are designed and built in a single configuration without the flexibility afforded by being able to adjust the structure according to need. Some structures, such as shelving, which provide for adjustable shelves normally require hardware connectors for supporting each shelf.

Applicant's U.S. Pat. No. 4,562,776 provides an expansible support system with modular elements which are easily assembled without the need for tools or fasteners, but the modular elements require considerable time and expense in cutting to form the interlocking slots on each piece. The many exposed slots in the final structure also present a maintenance problem in terms of keeping the slots free of dust. The orthogonal interlocking vertical structural support elements occupy a portion of the shelf space in that system, thereby wasting some of the shelf space.

DISCLOSURE OF THE INVENTION

The present invention solves the problems described herein and overcomes the shortcomings of prior art systems. Interlocking modular elements of the present system are formed by making simple crosscuts in uniform stock and mass assembling the pieces into modular units by gluing, screwing, or nailing the pieces together, thereby saving considerable time and effort in fabrication. The pieces may be pre-finished before assembling them into the modular units for speed and ease of finishing.

Interlocking modular elements are inserted into one another in a fast easy assembly process providing structural integrity without the need for fasteners or tools in the assembly process. Users of the system can easily assemble and disassemble structures with no need for special construction skills.

Vertical interlocking modular elements are stacked to form vertical structural supports. Horizontal elements are attached between two spaced vertical structural supports creating a structure which is expansible in the same plane or orthogonally by adding more vertical structural supports and horizontal supports extending outwardly from the structure.

In the preferred embodiment self-interlocking modular elements are interconnected in co-planar alignment to form flat vertical structural supports with a series of spaced horizontal slots for receiving first horizontal elements slidably therein to form a series of shelf-like components, which may be placed at various heights, thereby providing a more flexible self-supporting shelf system assembled without fasteners or tools.

The self-interlocking modular elements are formed by two or three or more identical elongated tenon elements aligned lengthwise in the same plane spaced apart by the width of each tenon element and interconnected by two side panels narrower in width than the length of the tenon elements and spaced apart the thickness of the tenon elements in parallel alignment sandwiching the tenon elements therebetween to form two or more tenons protruding from the top and bottom of the self-interconnecting modular element with a mortice between each pair of them equal to the width and thickness of each of the tenon elements. Each self-interlocking modular element is connectable to an adjacent similar element by offsetting one with the other and mutually sliding the tenons of one into the mortises of the other, thereby providing self-interconnecting modular elements that stack together to form vertical supports. The self-interlocking modular elements may be interconnected in a variety of ways to produce differently sized and patterned vertical supports.

The ends of the tenons on alternate self-interlocking modular elements contact one another leaving a slot between adjacent side panels sufficiently large to admit a horizontal shelving element in the slot. Horizonal shelving elements each have a notch, the length of the side panel in the self-interconnecting modular elements, cut into the bottom edge at each end, so that the horizontal shelving elements slide into any desirable pair of slots in adjacent vertical support structures and lock down onto the side panels with the top of each of the two side panels engaged in each end notch of the first horizontal element, thereby providing adjustable shelving which slides in and out and locks into place. Alternately, drawers or writing surfaces or other slidable elements may fit into the slots via protruding side edges shaped like the edges of the horizontal shelving elements.

Each side edge of each of the side panels is provided with an edge protrusion and a horizontal tie member has an elongated rigid horizontal body equal in length to the first horizontal elements and a pair of spaced vertical components at each end, each of the vertical components being provided with a means to engage the edge protrusions of the side panels so that the horizontal tie member is connectable between two vertical structural supports to hold them rigidly together. The preferred embodiment of the horizontal tie element, called an adjustable horizontal tie shelf, has a front vertical panel with attached posts which moves adjusably relative to the other elements of the adjustable horizontal tie shelf and connects thereto by a T bolt, so that the horizontal tie shelf binds a modular element between end posts for a tight connection.

The horizontal tie member further comprises a vertical back member having an opening at each end and a top horizontal tie member connects the two spaced vertical components at their top ends and a bottom horizontal tie member connects the spaced vertical components at their bottom ends, and an elongated adjustable length brace has protrusions at each end so that one protrusion fits into an opening in the top horizontal tie member adjacent to one vertical component and the other protrusion fits into an opening in the bottom horizontal tie member adjacent to the other vertical component creating a diagonal brace across the back of the assembled modular structural system for rigidity of the structural system. Alternatively, an adjustable lattice-type brace has two bottom pivot elements attached to a brace lock bar with both bottom lattice brace elements slidably attached to the brace lock bar and a top pivot point of the lattice-type brace attached to a horizontal tie member at the top of the structure forming an adjustable brace system to hold the structure in a rigid position and prevent twisting or racking of the structure.

The self-interlocking modular elements may be interconnected at right angles to one another to provide a vertical support for additional horizontal elements extending away from the first at a right angle, thereby producing a corner bookcase for example extending along two adjacent walls.

In an alternate embodiment having two modular elements, the first is an interlocking modular element having a pair of flat side panels in a parallel face-to-face alignment with two flat longer elongated elements sandwiched between the side panels. The two elongated elements are spaced apart in a planar side-by-side alignment leaving a vertical slot therebetween forming edge slots which extend through the space between the side panels forming a mortise opening running through the center of the interlocking modular element. The interlocking modular elements may be stacked together in an alternating orthogonal pattern with each edge slot intersecting with the edge slot of each adjacent orthogonal interlocking modular element so that each edge slot engages the panels of each adjacent interlocking modular element, thereby forming a first vertical structural support cross-shaped in cross-section.

The second modular element has a pair of spaced apart flat side panels with a longer flat central post sandwiched between the panels. The central post of the second modular element is the same width as the vertical slot between the elongated elements of the interlocking modular element. The central post forms a tenon extending beyond the side panels on the top and bottom so that when the interlocking modular elements and second modular elements are stacked vertically with the panels all in the same plane, alternating a first and a second modular element, the central vertical post tenon pieces of the second modular elements are inserted in the central vertical slot of the interlocking modular elements, fitting together in a mortise and tenon configuration, forming a structurally sound vertical second vertical structural support. The second vertical structural support is formed in a single plane orthogonal to the horizontal supports installed between the vertical structural supports, thereby allowing all of the space to be used on the horizontal supports.

The elongated elements of the interlocking modular element extend beyond the side panels on the top and bottom a distance slightly greater than half the height of the second side panels. The central post of the second modular element forms a central vertical tenon extending beyond the second side panels on the top and bottom a distance slightly greater than half the height of the first side panels. A vertical structural support is formed by vertically stacking alternate interlocking modular elements with second modular elements. The elongated elements contact each other and the central vertical tenons contact each other, rather than the side panels contacting one another, so that a horizontal slot is formed between the side panels of the interlocking modular elements and the second modular elements, thereby forming a series of horizontal slots in each vertical structural support on both sides of the vertical structural support, creating an adjustable structure which allows the first horizontal elements to be inserted in any of the horizontal slots as desired. Because the horizontal slots are formed on both sides of the vertical structural supports, a series of vertical structural supports may be lined up with horizontal supports running between each adjacent pair of vertical structural supports.

Second horizontal elements are formed with two elongated support elements spaced apart edge-to-edge in the same plane. A shorter reinforcing element attached to the bottom of each of the two elongated support elements secures the two together and inhibits the flexing of the elongated support elements. Since the reinforcing element is shorter than the two elongated elements, an open groove is left between the two elongated support elements at each end of the second horizontal element. With the second horizontal elements inserted in the horizontal slots formed in the vertical structural supports, a ribbon may be run vertically through the grooves at each end of the horizontal supports tying together the entire assembly to retain the horizontal supports in the vertical structural supports. Alternately, a peg can be placed through the groove into the vertical structural support to retain individual horizontal supports.

By stacking the interlocking modular elements on top of each other in an alternating orthogonal orientation, the system may be expanded in a direction orthogonal to the plane of the structure formed by a pair of facing end structures with interconnected horizontal supports.

BRIEF DESCRIPTION OF THE DRAWINGS

These and other details of my invention will be described in connection with the accompanying drawings, which are furnished only by way of illustration and not in limitation of the invention, and in which drawings:

FIG. 1 is a front elevational view of the preferred embodiment of the self-interlocking modular element;

FIG. 2 is an end elevational view of the preferred embodiment of FIG. 1;

FIG. 3 is a perspective view of the preferred embodiment of FIG. 1;

FIG. 8 is a bottom plan view of the first horizontal element;

FIG. 9 is an end elevational view of the first horizontal element;

FIG. 10 is an edge elevational view of the first horizontal element;

FIG. 13 is a front elevational view of a partial self-interconnecting modular element;

FIG. 14 is an end elevational view of the partial self-interconnecting modular element of FIG. 13;

FIG. 15 is a perspective view of the partial self-interconnecting modular element of FIG. 13;

BEST MODE FOR CARRYING OUT THE INVENTION

Figure 4:
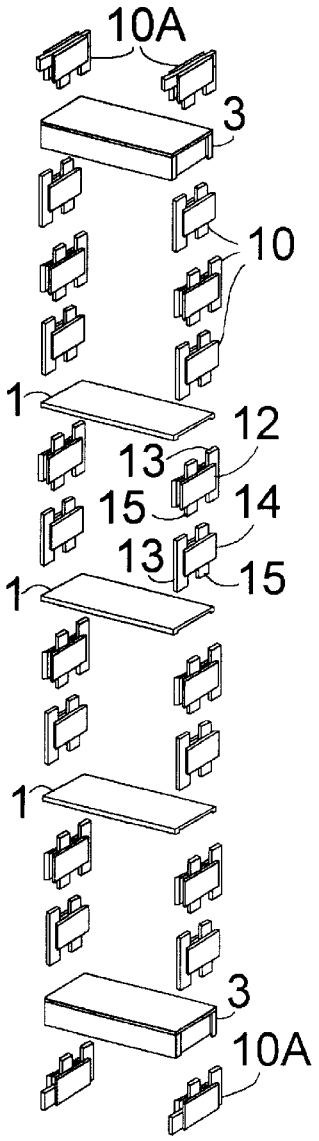
FIG. 4 is an exploded perspective view of the preferred embodiment of the adjustable expansible interlocking modular structural system showing the components aligned for assembly with the self-interlocking modular elements aligned in a configuration with the side panels aligned.

The modular structural system of the invention has interlocking members which may be assembled without tools and without connecting hardware. In FIGS. 1–12 and 29 and 31, the system comprises a series of interlocking modular elements 10 and 20 having interlocking connections therebetween interconnectable to form a vertical support structure. Each interlocking modular element 10 and 20 has a pair of flat side panels 12 & 14 and 22 & 24, respectively, spaced apart in a face-to-face parallel alignment and at least two longer elongated elements 13 & 15 and 23 & 25, respectively, spaced apart to create a vertical slot 11 and 21, respectively, and sandwiched between the side panels and attached thereto by an attaching means, which may be fasteners 19, such as nails or screws, or an adhesive 28, or other means of securing wood together or each interlocking modular element 10 and 20 may integrally cast from a material such as plastic or concrete or other formable material requiring no connectors. The elongated elements 13 & 15 and 23 & 25 are spaced apart a sufficient distance to accommodate the side panels of an adjacent modular element slidably in the vertical slot 11 and 21 therebetween with the adjacent modular element positioned orthogonally, as in FIGS. 21, 25 and 31. The interlocking modular elements are structured so that when they are interconnected in the vertical support structure 87 (in FIG. 31) a series of horizontal slots 29 is formed between the side panels 12 & 14 and 22 & 24 of the adjacent interlocked modular elements.

In FIGS. 8–10 and 27 a horizontal element 1 and 30, respectively, has at each end a means for engaging one of the horizontal slots 29 in the vertical support structure so that two spaced apart vertical support structures support a series of horizontal elements therebetween, the horizontal elements positioned adjustably in selected horizontal slots 29, as seen in FIGS. 5, 7,12,28, 31, and 32.

In FIGS. 1–18, showing the preferred embodiment of the system, each of the modular elements, as best seen in FIGS. 1–3, comprises a self-interlocking modular element 10 having at least two equal elongated elements 13 and 15 sandwiched between the side panels 12 and 14 and spaced apart by the width of one of the elongated elements to form the vertical slot 11 therebetween. The portion of the vertical slot between the side panels forms a mortice. A portion of each of the elongated elements protrudes above the side panels and a portion protrudes below the side panels 12 and 14, the protruding portions forming top and bottom tenons of one self-interlocking modular element 10. Each tenon is insertable in the mortice of an adjacent self-interlocking modular element to form a rigid connection therebetween. A series of interconnected self-interlocking modular elements 10 forms a planar vertical support structure 85A, 85B, and 85C which may have different patterns by alternating which tenon is inserted in the mortice.

Figure 5:
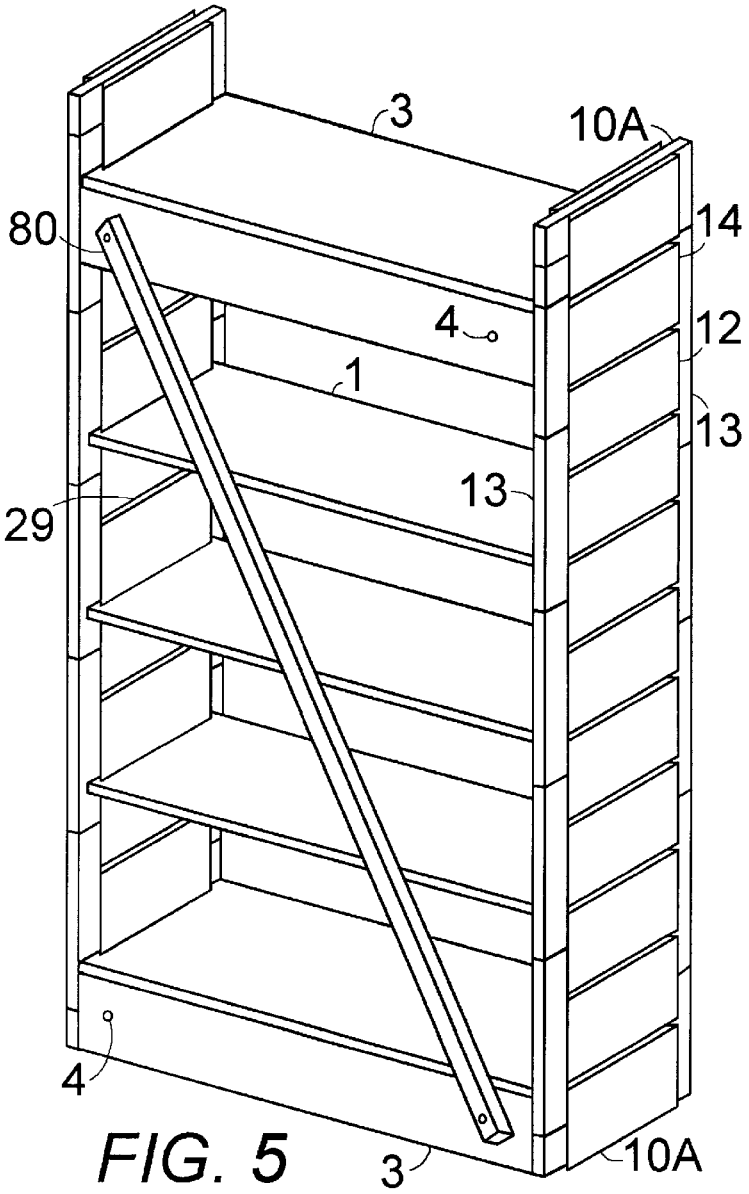
FIG. 5 is a perspective view of the fully assembled preferred embodiment of the system configured as in FIG. 4.

In FIGS. 4 and 5 each adjacent self-interlocking modular element 10 is positioned in planar alignment but turned 180 degrees from the neighboring self-interlocking modular element 10, so that all of the side panels 12 and 14 and all of the outside elongated elements 13 are in vertical alignment (as seen in FIG. 5) in the planar vertical support structure 85A. The side panels 12 and 14 are secured to the elongated members 13 and 15 with one edge of each side panel centrally aligned on one of the elongated members 13 and the other edge extending beyond the other elongated member 15, so that when they are shifted by 180 degrees and the covered elongated member 15 is inserted in each mortice II of the adjacent self-interlocking modular element, the alignment of side panels 12 and 14 and half covered elongated members 13 is configured in the planar vertical support structure 85A.

Figure 6:
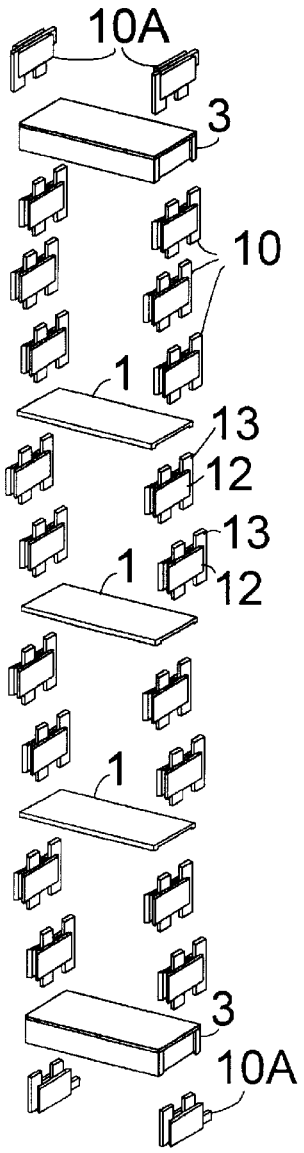
FIG. 6 is an exploded perspective view of the preferred embodiment of the system showing the components aligned for assembly with the self-interlocking modular elements aligned in an alternate configuration with the side panels staggered to one side only.
Figure 7:
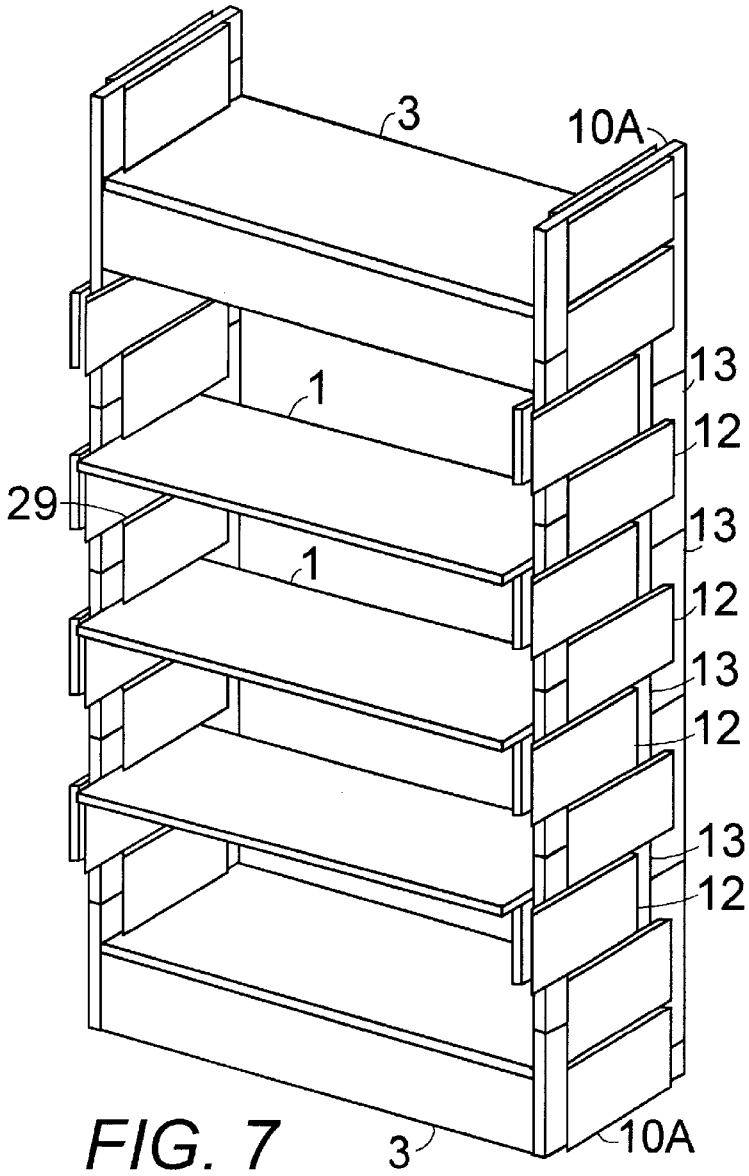
FIG. 7 is a perspective view of the fully assembled preferred embodiment of the system configured as in FIG. 6.

In FIGS. 6 and 7 each adjacent self-interlocking modular element 10 is in planar alignment but shifted forward by the width of an elongated element so the half covered elongated elements 13 are inserted in the adjacent mortises 11 to form a planar vertical support structure 85B having a configuration with alternate side panels 12 staggered to one side with the side panels protruding on one edge of the planar vertical support structure 85B.

Figure 11:
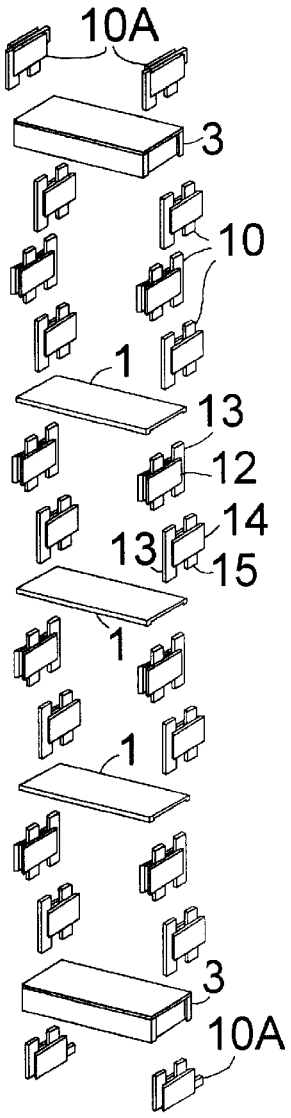
FIG. 11 is an exploded perspective view of the preferred embodiment of the system showing the components aligned for assembly with the self-interlocking modular elements aligned in an alternate configuration with the side panels staggered to both sides.
Figure 12:
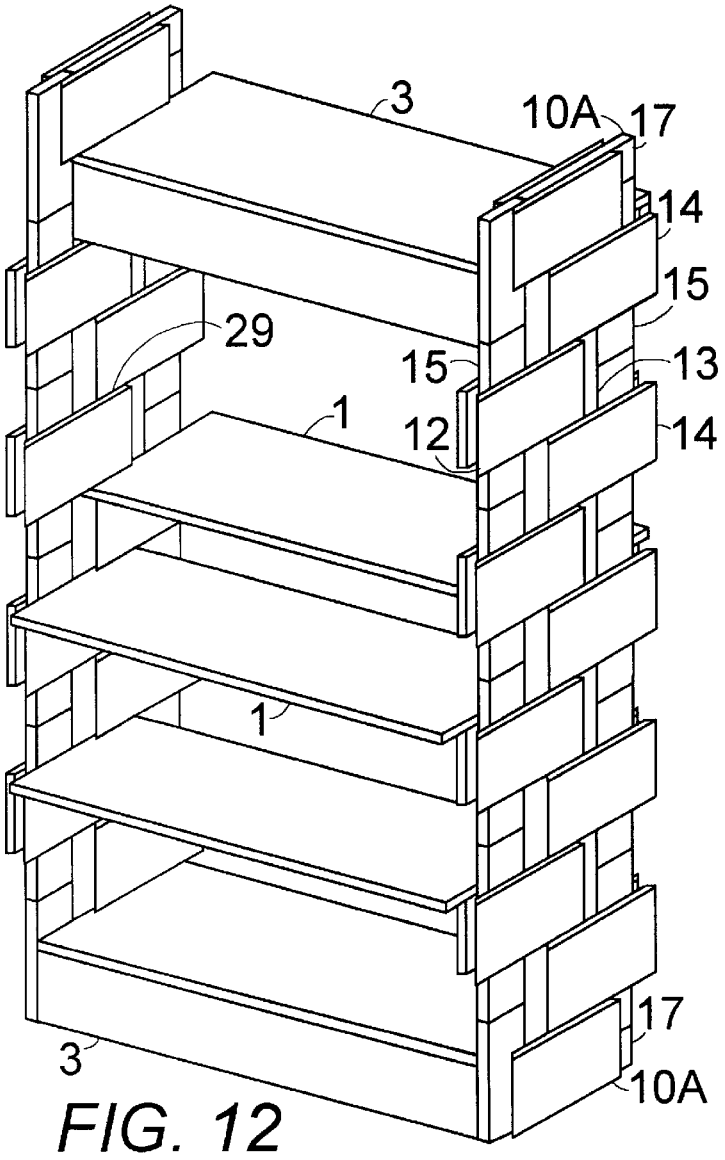
FIG. 12 is a perspective view of the fully assembled preferred embodiment of the system configured as in FIG. 11.

In FIGS. 11 and 12 each adjacent self-interlocking modular element 10 is in planar alignment and rotated 180 degrees and shifted forward by the width of an elongated element so the half covered elongated elements 13 are inserted in the adjacent mortises 11 to form a planar vertical support structure 85C having a configuration of the side panels 12 and 14 staggered to both sides with the side panels protruding on both edges of the planar vertical support structure 85C.

In FIGS. 13–15, a modified self-interlocking modular element 10A comprises two side panels 12 and 14 sandwiching a partial elongated element 13A partially protruding out of only one side of the side panels and a T-shaped second elongated element 15A partially protruding out of the same side of the side panels and having a protruding tab 17 formed by one of the cross portions of the T protruding out of the end of the side panels. Both sides of the cross portion of the T engage tenons from adjacent self-interlocking modular elements and the modified self-interlocking modular elements 10A serve to finish off the top and bottom of the planar vertical support structures 85A, 85B, and 85C forming squared off top and bottom ends. More importantly, the self-interlocking modular element 10A keeps the support elements the right distance above each other to maintain the proper width of the horizontal slots 29, and can be placed anywhere as needed.

Figure 21:
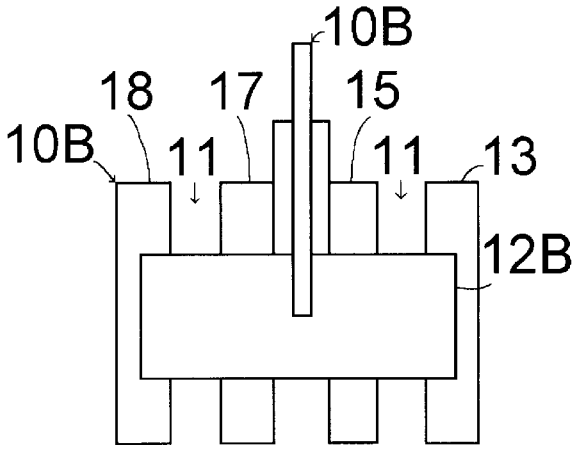
FIG. 21 is a front elevational view of two self-interlocking modular elements having four elongated elements and interconnected orthogonally.
Figure 22:
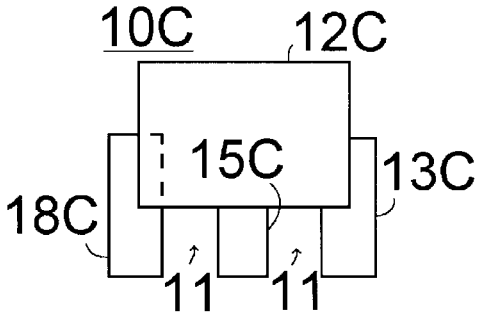
FIG. 22 is a front elevational view of a half sized triple tenon support.

In FIG. 21 an alternate self-interlocking modular element 10B has four equal elongated elements 13, 15, 17, and 18 sandwiched between elongated side panels 12B. In is understood that there may be two, three, four or more elongated elements forming protruding top tenons and protruding bottom tenons with mortises therebetween forming planar vertical structural supports of varying widths and patterns formed by alternating which tenon is inserted in which mortice. Two self-interlocking modular elements 10B are shown in FIG. 21 interconnected orthogonally to be used in forming a vertical structural support having orthogonally intersecting members. In FIG. 22 another modified self-interlocking modular element 10C has three partial elongated elements 13C, 15C and 18C forming tenons by protruding on only one side of the side panels 12C. This configuration could be used in finishing the ends of a vertical structural support or in finishing a wall structure.

As seen in FIGS. 1–3, each of the side panels 12 and 14 is equal in vertical length to less than half of the vertical length of each of the elongated members 13 and 15 so that, in the vertical structural support 85A, in FIG. 5, formed of the series of vertically connected self-interlocking modular elements 10, the tenons of alternate self-interlocking modular elements contact each other in the mortice of the intermediate self-interlocking modular element leaving each of the adjacent side panels spaced apart providing two of the series of horizontal slots 29.

In FIGS. 8–10, each of the horizontal elements comprises an elongated planar member 1 slightly thinner than each of the horizontal slots 29 and having a bottom edge slot 2 in the bottom edge of each end equal in length to the horizontal length of each of the side panels 12 and 14, forming a first horizontal element 1 so that each end of the first horizontal element is removably insertable in any of the horizontal slots formed between the side panels and each end of each of the first horizontal elements engages a side panel 12 and 14 in the bottom edge slot 2.

Figure 16:
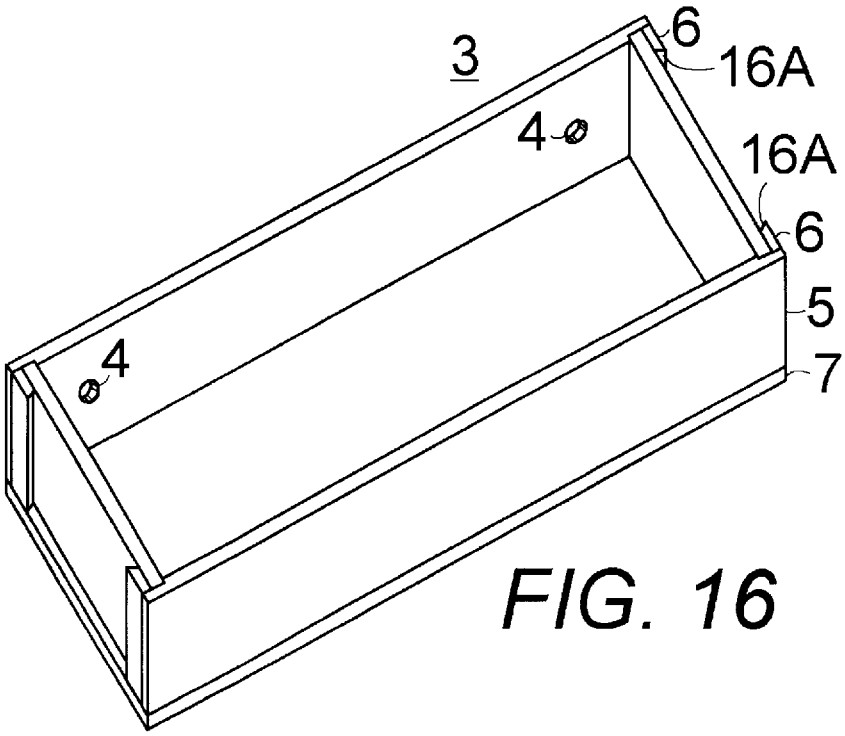
FIG. 16 is a perspective view of a horizontal tie member.
Figure 17:
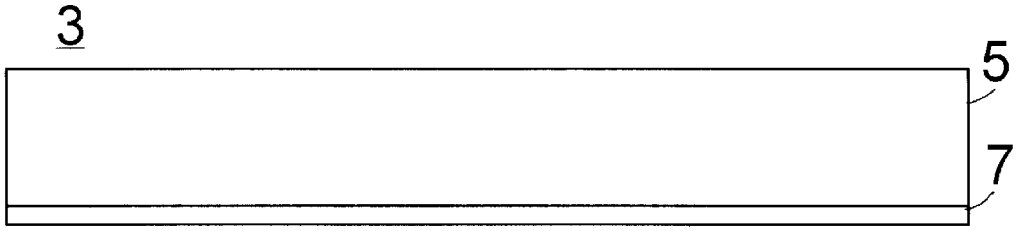
FIG. 17 is a side elevational view of the horizontal tie member of FIG. 16.
Figure 18:
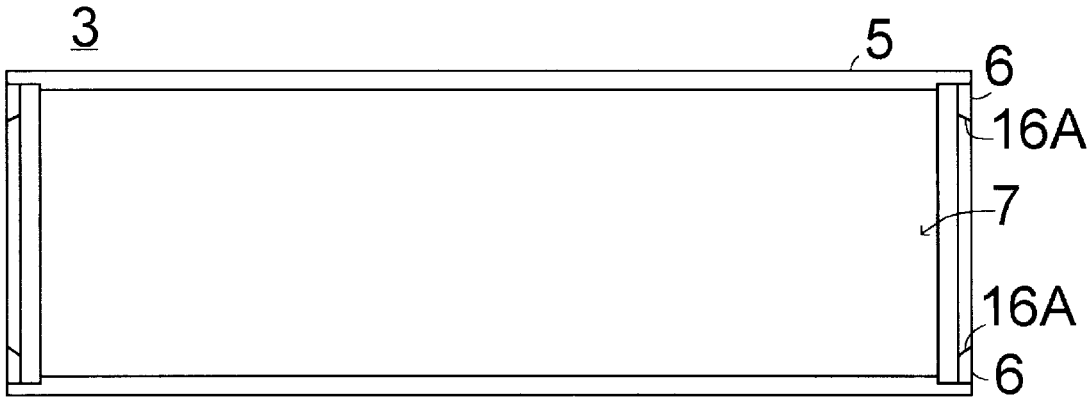
FIG. 18 is a bottom plan view of the horizontal tie member of FIG. 16.

In FIG. 3, each side edge of each of the side panels is provided with a dado or edge groove 16, such as that formed by beveling the edge with the edge angled outwardly. In FIGS. 16–18, a horizontal tie member 3 has an elongated rigid horizontal body equal in length to the first horizontal elements 1 and a pair of spaced vertical components at each end 6, each of the vertical components being provided with a beveled edge groove 16A means to engage the edge groove 16 of the side panels so that the horizontal tie member is connectable between two vertical structural supports to hold them rigidly together by sliding the horizontal tie member 3 down onto the side panels 12 and 14 of the vertical support structure 85A, 85B, and 85C at both the top and bottom of the vertical support structure as seen in FIGS. 5, 7, and 12. The horizontal tie members 3 rigidly connect the two vertical support structures together. The horizontal tie members 3 can be placed anywhere in the structure and can be connected in a chain to expand units sideways.

The horizontal tie member 3 further comprises a horizontal base 7 and vertical sides 5 including a back side member having an opening 4 at each end and, in FIG. 5, a top horizontal tie member 3 connects the two spaced vertical components 85A at their top ends and a bottom horizontal tie member 3 connects the spaced vertical components 85A at their bottom ends.

Figure 20:
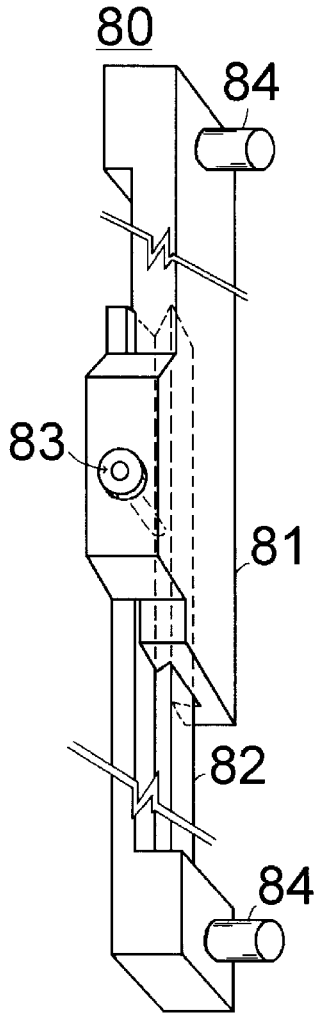
FIG. 20 is a partial perspective view of an adjustable elongated brace.

In FIG. 20, an elongated adjustable cross brace 80 has protrusions 84, such as wooden pegs, at each end so that one protrusion fits into an opening 4 in the top horizontal tie member adjacent to one vertical component and the other protrusion fits into an opening 4 in the bottom horizontal tie member adjacent to the other vertical component creating a diagonal brace across the back of the assembled modular structural system. Two rigid members 81 and 82 are slidably interconnected by a dovetail joint adjustably tightened by a screw 83 or other means.

Figure 39:
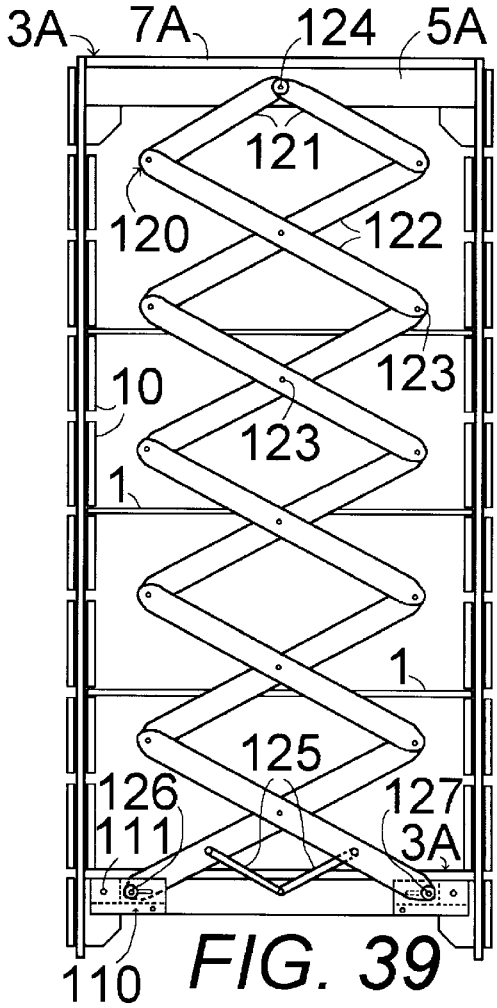
FIG. 39 is a back elevational view of the structure with ad adjustable lattice brace mounted on the back.

In FIGS. 33–36, an alternate horizontal tie member comprises an adjusting horizontal tie shelf 3A having a flat broad horizontal surface 7A for use as a shelf in the assembled structure and four comer posts 6A having angled beveled slots 16B to engage the edge grooves 16 of the side panels 10 so that the horizontal tie shelf 3A is connectable between two vertical structural supports to hold them rigidly together by sliding the horizontal tie shelf 3A down onto the side panels 12 and 14 of the vertical support structure at both the top and bottom of the vertical support structure as seen in FIG. 39. The horizontal tie shelves 3A rigidly connect the two vertical support structures together. The horizontal tie shelves 3A can be placed anywhere in the structure and can be connected in a chain to expand units sideways.

The horizontal tie shelf 3A further comprises a back vertical side 5A permanently connected to the horizontal surface 7A and to the two adjacent posts 6A by gluing or other attaching means and a front vertical side 5B not attached to the horizontal surface, but having the two adjacent posts 6A permanently attached to the front vertical side. The front vertical side 5B has holes 4A adjacent to the ends for receiving eye bolts 105 screwed into T nuts 104 inserted through transverse openings 103 with protruding eye bolt handles 101 for screwing them in a desired distance, so that the front vertical side is adjustable relative to the end side walls to which it is attached by the eye bolts. This adjustability enables relative movement between the corner posts 6A at each end (one of which is secured to the front vertical side) to enable tightening of the adjustable horizontal tie shelves 3A to the modular elements 10 for a tight fit and to accommodate various sizes of side panels 12 and 14 inserted into the angled beveled slots 1 6A. The corner posts may be angled by cutting along dashed lines 102 producing the angled corner posts seen in FIG. 39. On the top horizontal tie shelf a center opening 4B (shown dashed) would receive a bolt inserted through the top angle 124 of the lattice brace 120 (as seen in FIG. 39) screwed into a T nut inserted in transverse opening 103 interconnecting with opening 4B. The back vertical side of the bottom horizontal tie shelf 3A would have an opening (not shown) therethrough adjacent to each end for receiving dowels 111 (seen in FIGS. 37 and 38) or bolts from the lattice brace lock bar 110 as seen assembled in FIG. 39.

Figure 37:
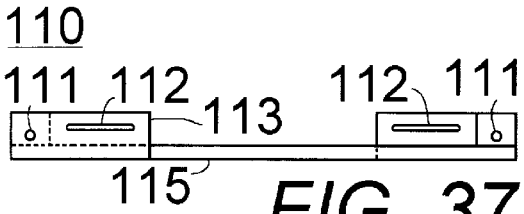
FIG. 37 is a front elevational view of a lattice brace lock bar.
Figure 38:
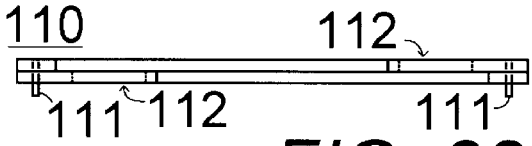
FIG. 38 is a top plan view of the lattice brace lock bar of FIG. 37.

In FIGS. 37 and 38, a lattice brace lock bar 110 has a protrusion, such as a dowel 111 or a bolt, at each end so that the protrusions fit into holes (not shown) in the vertical side of the back tie shelf 3A on the bottom of the structure. In FIG. 39 an alternate lattice brace lock bar 110A has two separate sides screwed or bolted into the back tie shelf 3A on the bottom of the structure. Horizontal slots 112 at each end slidably receive adjustable bolt connections from the two bottom members of the lattice brace 120 at the end pivot points 126 and 127. The adjustable lattice brace 120 is formed primarily of large scissor-type pivotable connections formed by large pivot members 122 connected at each end and in the center by pivot joints 123. With the top of the lattice brace connected to the top horizontal tie shelf at its center point and the bottom of the lattice brace slidably connected at the two bottom points, the lattice brace is adjustable to any desired height depending on the height of the structure. Tightening the bolts in the bottom of the lattice brace 120 to the lattice brace lock bar 110 or 110A and the bolt at the top of the lattice to the top horizontal tie shelf creates a rigid brace on the back of the structure to prevent twisting or racking of the structure. Additional small pivot members 125 are pivotally connected between the two bottom large pivot members which are connected to the lattice brace lock bar.

Figure 40:
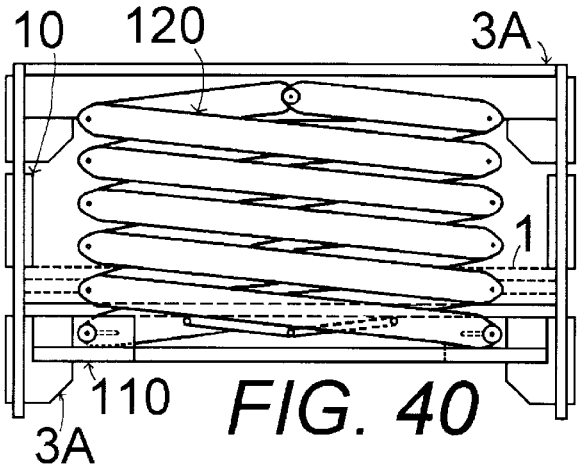
FIG. 40 is a back elevational view of the structure of FIG. 39 with the system in a compact assembly for storing or transporting.
Figure 41:
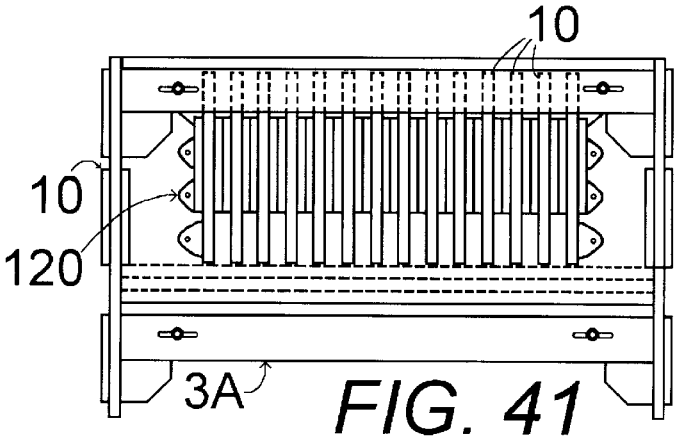
FIG. 41 is a front elevational view of the structure of FIG. 40 with the system in a compact assembly for storing or transporting.

In FIGS. 40 and 41 the lattice brace 120 is completely collapsed down on the bottom horizontal tie shelf with only three modular elements 10 interconnected on the ends to connect the two horizontal tie shelves 3A and the remaining modular elements 10 and shelves 1 are stored therein for shipping or storage.

Figure 24:
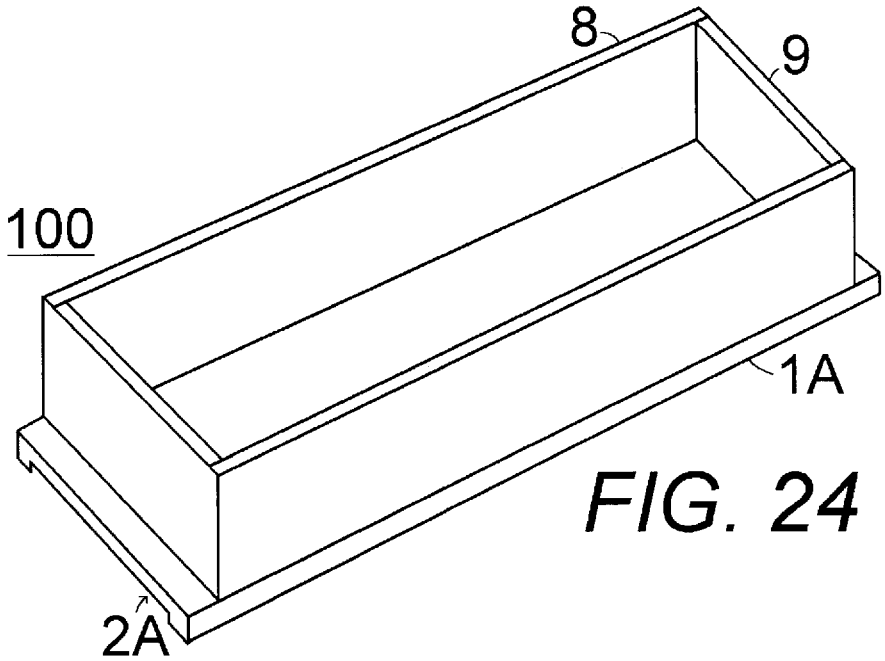
FIG. 24 in a perspective view of a slide-in storage unit.

In FIG. 24, a storage element 100 has at least one storage space formed by a bottom surface 1A and vertical side walls 8 and end walls 9 extending upwardly therefrom and having slot engaging ridges protruding from each end to slidably engage the horizontal slots 29 of the vertical structural supports. The ridges may be provided with a bottom edge slot 2A at each end to engage the side panels 12 and 14 in a similar fashion to the horizontal elements 1. This would provide a sliding drawer-type storage unit which could slide into any desired pairs of horizontal slots 29 between the vertical support structures as shown in FIG. 5.

Figure 25:
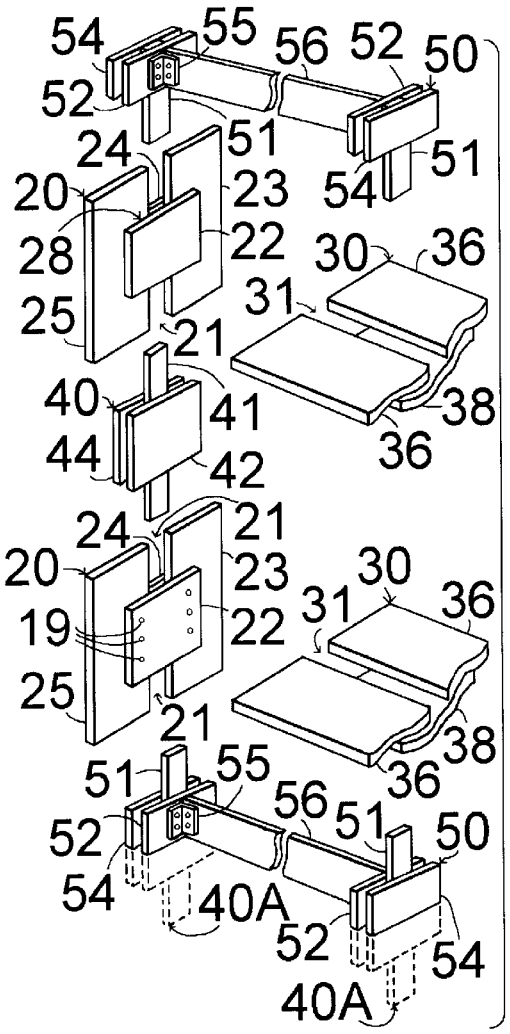
FIG. 25 is an exploded perspective view of an alternate embodiment of the adjustable expansible interlocking modular system showing the components aligned for assembly.
Figure 26:
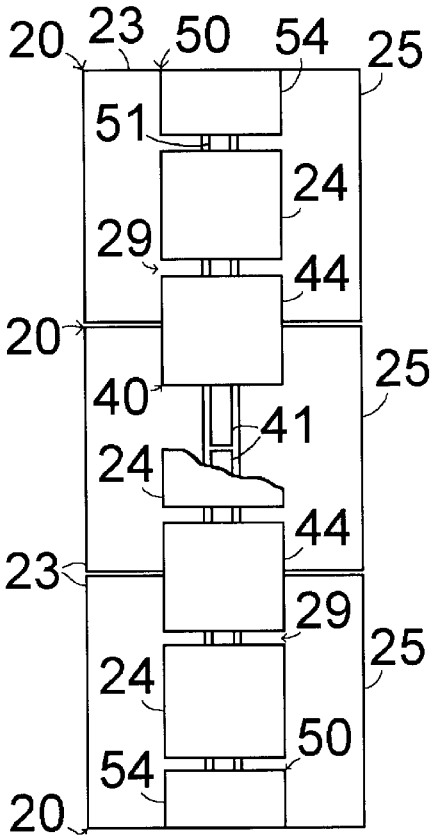
FIG. 26 is a side elevational view of a vertical structural support of the system of FIG. 25.
Figure 27:
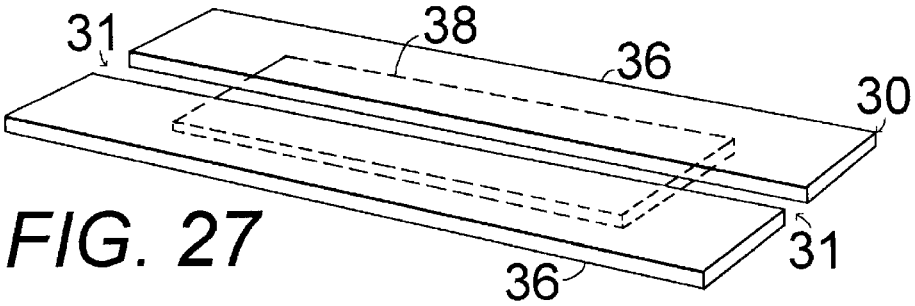
FIG. 27 is a perspective view of a horizontal member of the system.
Figure 28:
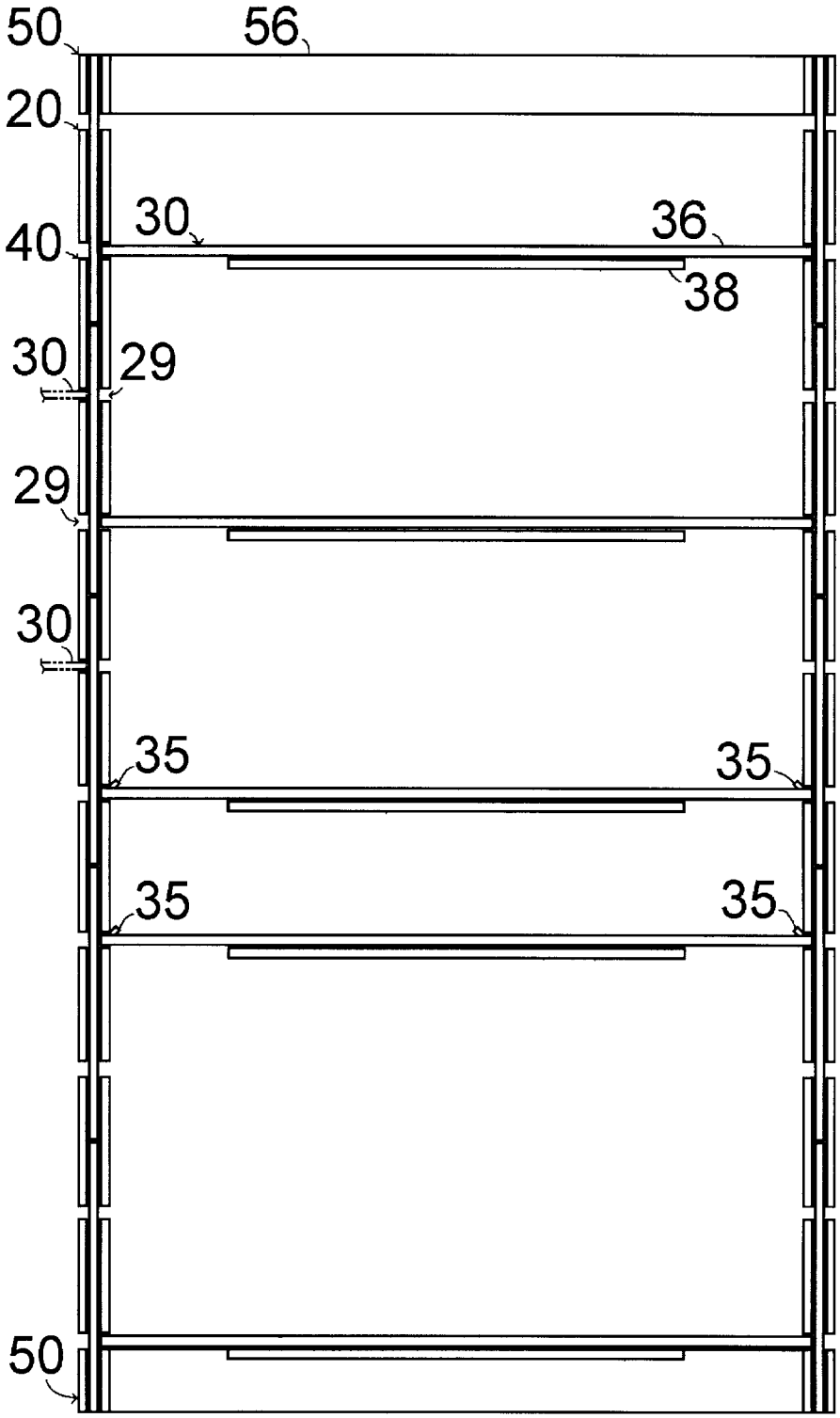
FIG. 28 is a front elevational view of an expansible adjustable shelving structure assembled from the interlocking modular components of FIG. 25.

In FIGS. 25–28, an alternate embodiment of a modular structural system comprises a series of interlocking modular elements 20 and a series of second modular elements 40 interlocked in a stacked planar arrangement alternating an interlocking modular element and a second modular element to form a planar vertical structural support 86, as seen in FIGS. 26 and 28. A pair of vertical structural supports support a series of second horizontal elements 30 positioned adjustably between the vertical structural supports.

Each interlocking modular element 20 has a pair of flat side panels 21 and 23 spaced apart in a face-to-face parallel alignment and a pair of flat elongated elements 23 and 25 longer than the flat side panels and sandwiched between the side panels. The elongated elements 23 and 25 are spaced apart in a planar side-by-side alignment creating a vertical slot 21 therebetween. The elongated elements 23 and 25 extend out beyond the top and the bottom of the side panels 22 and 24 so that the vertical slot 21 creates a top edge slot and a bottom edge slot each equal in width to the outside distance between the side panels. A securing means, such as an adhesive 28 as in the top interlocking modular element or nails, bolts, or screws 19 as in the bottom interlocking modular element, securing the side panels 22 and 24 and the elongated elements 23 and 25 together or the elements can be cast integrally from plastic, cement, or other formable material not requiring any fasteners.

Figure 29:
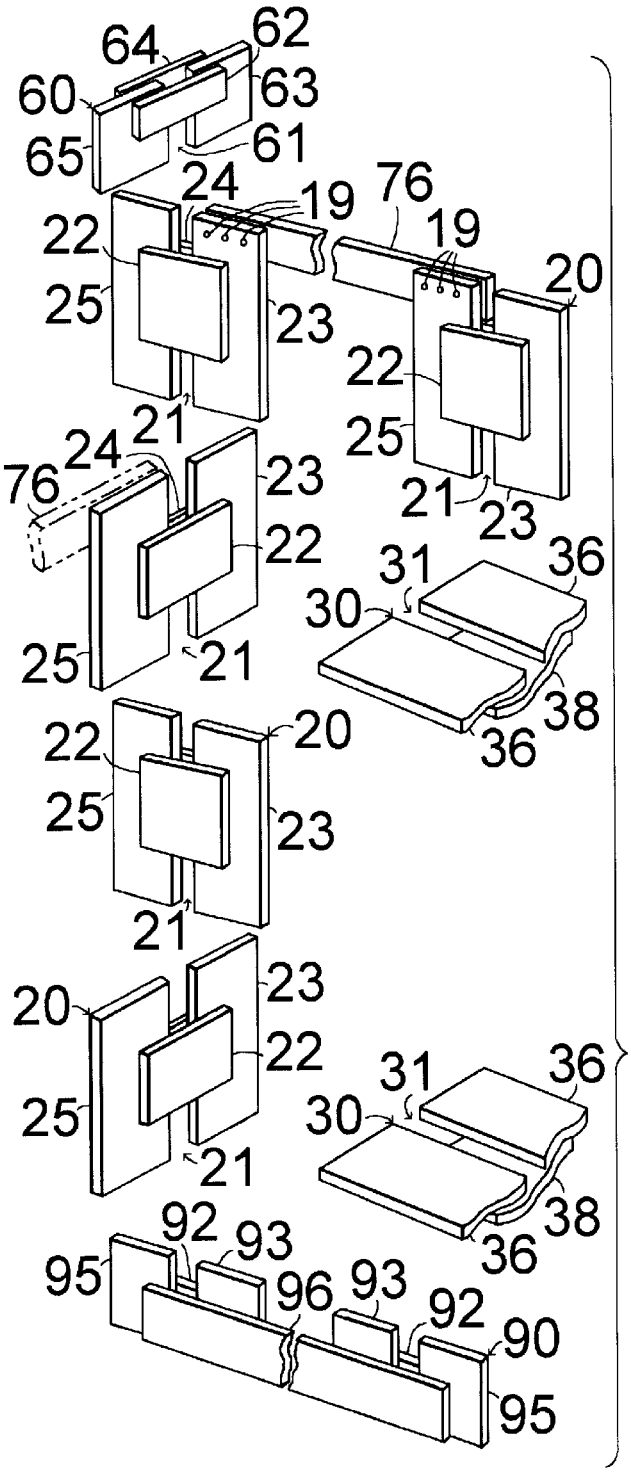
FIG. 29 is an exploded perspective view of another alternate embodiment of the adjustable expansible interlocking modular system showing the components aligned for assembly.
Figure 31:
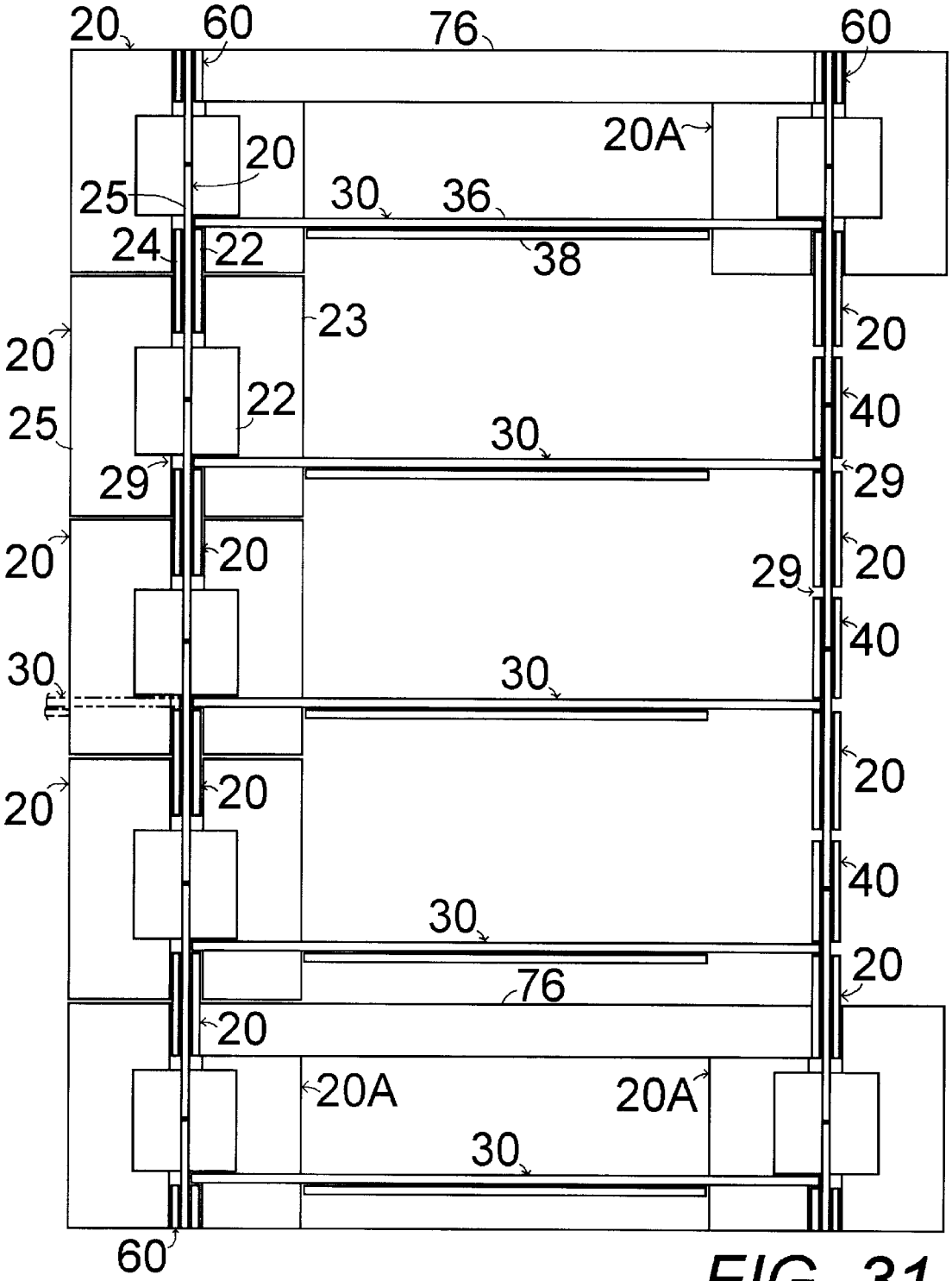
FIG. 31 is a front elevational view of an expansible adjustable shelving system assembled according to a combination of the interlocking modular elements of FIGS. 25 and 29.

In FIGS. 29 and 31, the interlocking modular elements 20 are interconnectable one with another by vertically stacking them in an alternating orthogonal arrangement, each edge slot 21 engaging the edge slot 21 and side panels 22 and 24 of the adjacent interlocking modular element to form a vertical structural support, as seen on the left of FIG. 31, at least a portion of which is formed by orthogonally intersecting interlocking modular elements.

In the alternate embodiment of FIGS. 25–28, the vertical slot 21 extends along the entire length of the elongated elements creating a mortise opening vertically through the interlocking modular elements. Each second modular element 40 has a pair of flat second side panels 42 and 44 spaced apart in a face-to-face parallel alignment and an upper and lower tenon protrusion sandwiched between the second side panels, formed by a single central post 41 sandwiched between the second side panels and rigidly attached to both of the second side panels by a securing means similar to the securing means of the interlocking modular elements. The central post 41 extends higher and lower than the second side panels 42 and 44 forming the tenon protrusion extending above and below the second side panels and through the space between the second side panels. The central post 41 is equal in thickness to the thickness of the elongated elements and equal in width to the space between the side panels, each tenon protrusion sized to fit in the mortise opening of the interlocking modular elements.

By stacking the interlocking modular elements 20 and the second modular elements 40 alternating an interlocking modular element and a second modular element with the side panels all aligned in a coplanar configuration, the tenons 41 of the second modular elements engage the mortises 21 of the interlocking modular elements forming a second vertical structural support 86, at least a portion of which is formed by coplanar aligned interlocking modular elements as seen in FIGS. 26 and 28.

Each of the elongated elements 23 and 25 of the interlocking modular elements 20 is equal in vertical length to the vertical length of each of the central posts 41 of the second modular elements 40 so that the elongated elements 23 and 25 of one interlocking modular elements contact the elongated elements 23 and 25 of the next neighboring interlocking modular element, as seen in FIG. 26, and the central post 41 of one second modular element contacts the central post 41 of the next neighboring second modular element in the vertical structural support 86 as seen in the broken away panel of FIG. 26.

Each of the side panels 22 and 24 and each of the second side panels 42 and 44 is equal in vertical length to less than half of the vertical length of each of the elongated elements 23 and 25 and to less than half of the vertical length of each of the central posts 41, so that, in the first vertical structural support, each of the adjacent side panels are spaced apart leaving a horizontal slot 29 therebetween. A series of horizontal slots 29 is formed on both sides of the first vertical structural support 86, as seen in FIG. 28, and second vertical structural support 87, as seen in FIG. 31 (left side). Second horizontal elements 30 may be inserted in the slots on either side of the vertical structural supports, so that two or a series of vertical structural supports may be lined up with the second horizontal elements inserted therebetween, the second horizontal elements positioned adjustably in the horizontal slots 29, the second horizontal elements resting on selected side panels. The ends of the second horizontal elements 30 are sized to fit within the horizontal slots 29 with a tight friction fit as a means for engaging the panels of the vertical structural supports or they may have end grooves 2 as in the first horizontal elements 1 as seen in FIGS. 8–10 so that the slots of the second horizontal elements 30 engage the side panels.

In FIG. 27, each of the second horizontal elements 30 comprises two horizontal planar members 36 spaced apart in planar alignment and a single reinforcing element 38 interconnecting the horizontal planar members. The reinforcing element 38 is rigidly attached to both horizontal planar members on an underside of the horizontal planar members by a similar means to the means attaching the interlocking modular elements, forming a rigid second horizontal element with an open slot 31 at each end. Each end of the second horizontal element is reversibly insertable in the horizontal slot 29 formed between the panels. In the second vertical structural support 87 of FIGS. 29 and 31 (left side), the inwardly protruding elongated elements 23 of the first modular elements 20 fit within the end slots 31 of the second horizontal elements 30.

The interlocking modular elements 20 and the second modular elements 40 each comprise planar members interconnected in parallel alignment by a securing means, wherein the planar members are produced from the same stock shaped to form each of the planar members. Most planar members of the system can be fabricated by crosscutting standard stock, such as 1"×6" boards, into the desired lengths to form the planar members. The central posts 41 of the second modular elements can be fabricated by crosscutting the desired length and then cutting lengthwise into desired widths.

Figure 32:
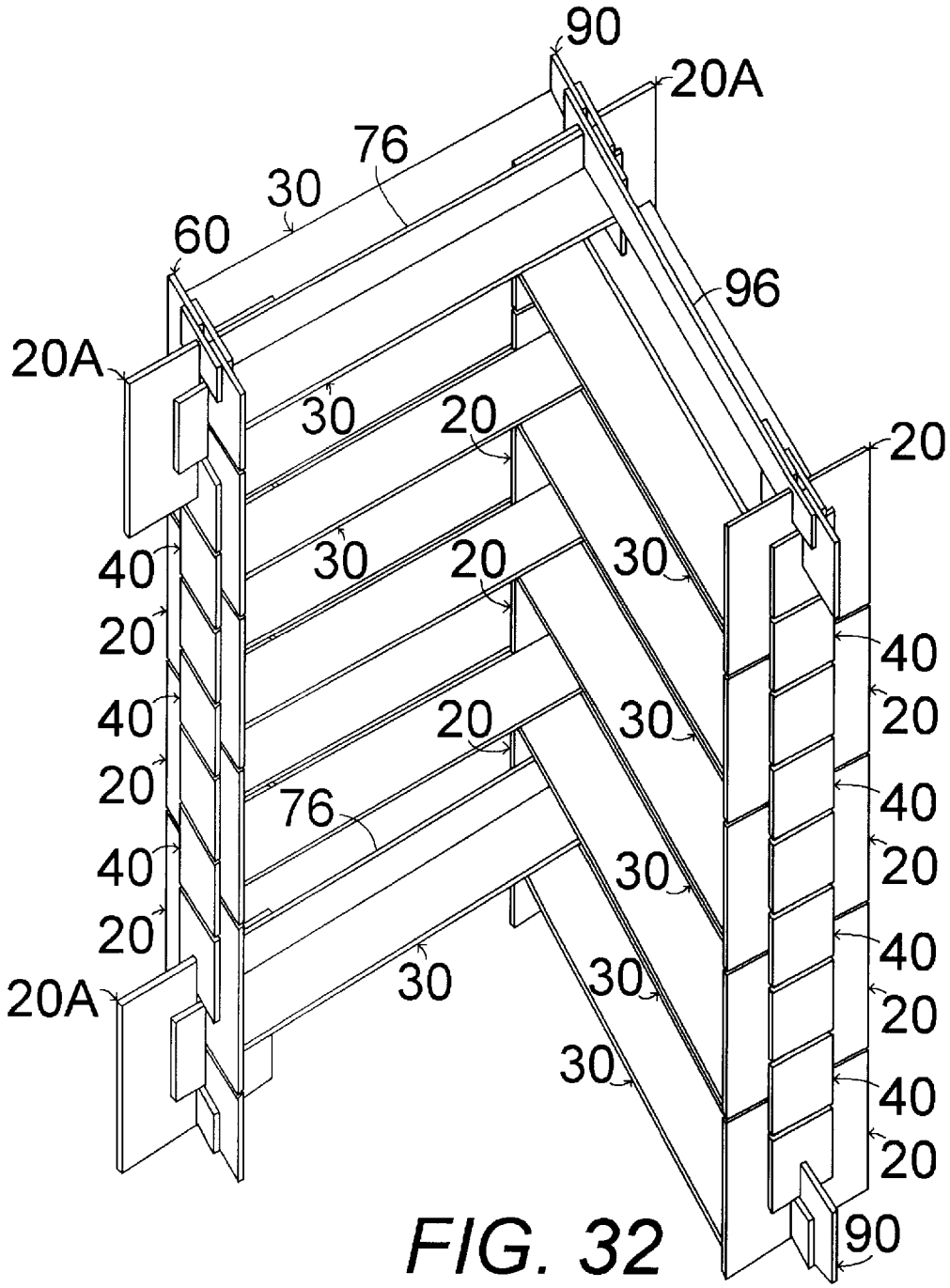
FIG. 32 is an orthogonal projection view of a shelving system expanded in orthogonal directions assembled according to a combination of the interlocking modular elements of FIGS. 25 and 29.
Figure 33:
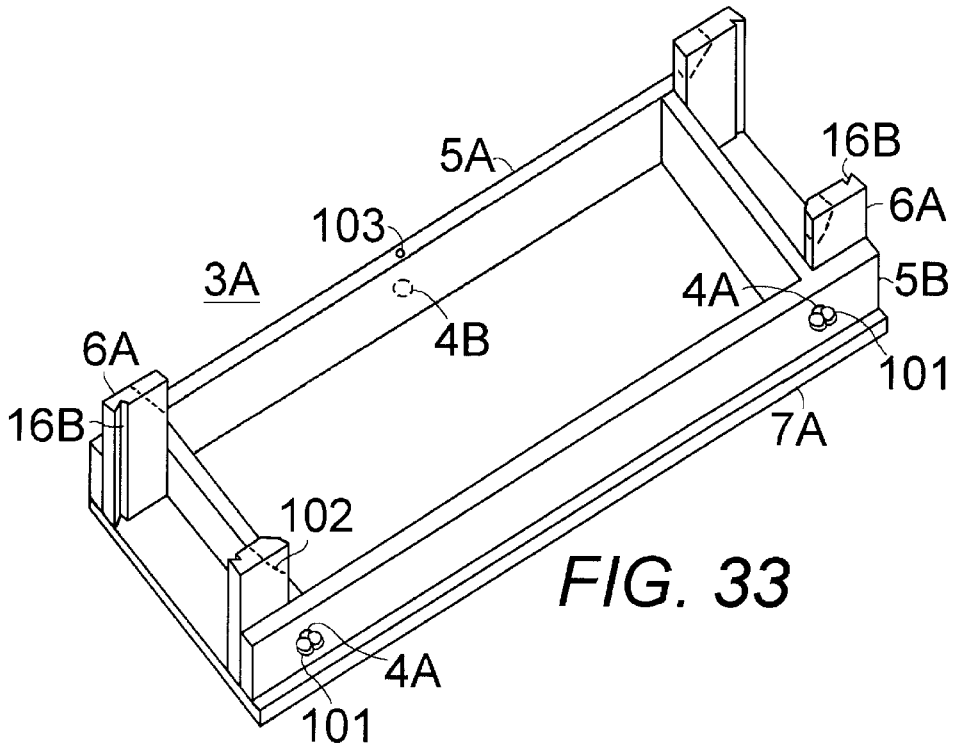
FIG. 33 is a perspective view of a bottom of an alternate adjusting horizontal tie shelf.
Figure 34:
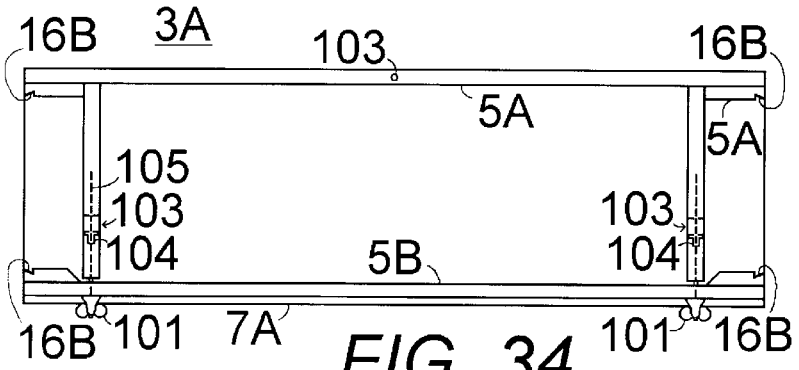
FIG. 34 is a bottom plan view of the adjusting horizontal tie shelf of FIG. 33.
Figure 35:
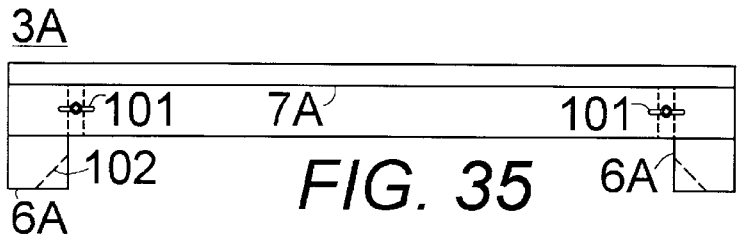
FIG. 35 is a front elevational view of the adjusting horizontal tie shelf of FIG. 33.
Figure 36:
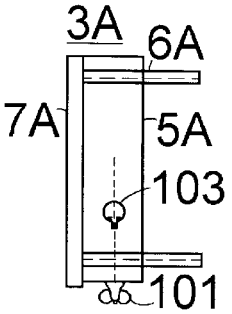
FIG. 36 is an end elevational view of the adjusting horizontal tie shelf of FIG. 33.

In FIG. 29, a tie for connecting vertical structural supports comprises an elongated first tie member, 76 having an interlocking modular element 20 secured by a securing means 19 such as nails, bolts, or screws, in planar alignment with the first tie member at each end thereof so that each end interlocking modular element interlocks into each first vertical structural support, as seen in FIGS. 31 and 32. The bottom tie element 90 comprises a tie member 96 having a portion of a interlocking modular element having partial elongated elements 93 and 95 sandwiched between an extension of the tie member 96 across the elongated elements and an opposing parallel spaced partial panel 92. The bottom tie element 90 ties the two vertical structural supports together at the bottom and serves as a base for the structure. A cap element 60 at the top of FIG. 29 is a partial interlocking modular element having partial panels 62 and 64 spaced apart in face-to-face parallel alignment and partial elongated elements 63 and 65 spaced apart and sandwiched between the partial panels. The cap fits into the top of the vertical structural support to cap it.

In FIG. 25, a tie for connecting vertical structural supports comprises a second elongated tie member 56 having a second modular element secured orthogonally to the second tie member at each end thereof by a bracket 55 or other securing means, as in the bottom element with the remainder of the full second modular element shown dashed or a portion 50 of the second modular element, such as the partial panels 52 and 45 and partial central post 51 secured at each end, so that each end second modular element or portion of the second modular element interlocks into each second vertical structural support, tieing the vertical structural supports together.

In FIG. 32, the interlocking modular elements 20, at one end, are interlocked into one vertical structural support orthogonally to a first plane formed by the vertical structural supports and the second horizontal elements 30, and the interlocking modular elements 20, at the other end, are interlocked into a separate vertical structural support forming, along with the one vertical structural support and a separate series of second horizontal elements 30, a second plane orthogonal to the first plane.

Figure 19:
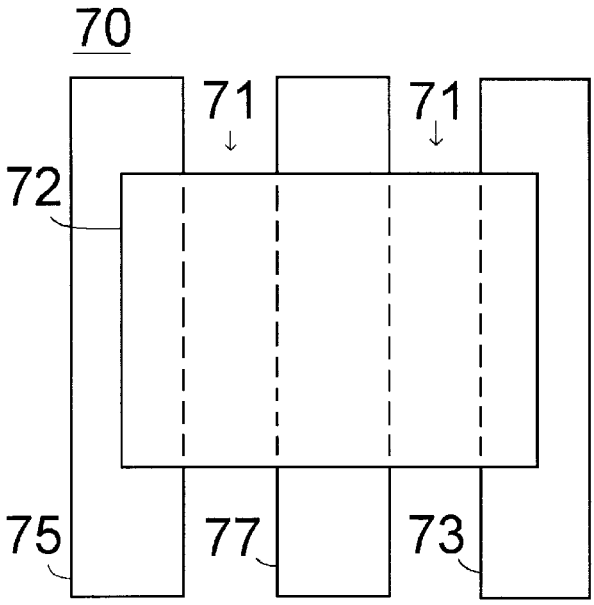
FIG. 19 is a front elevational view of a triple tenon support.
Figure 23:
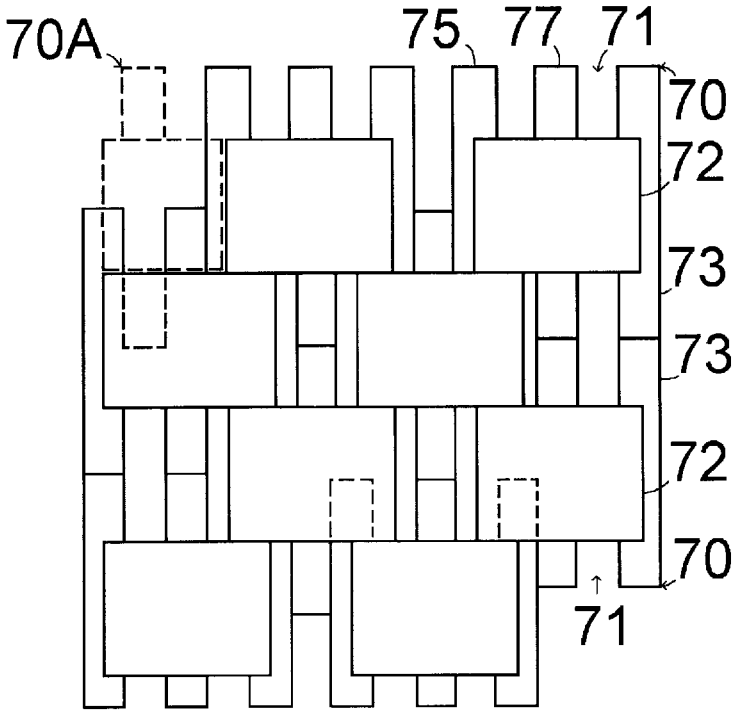
FIG. 23 is a front elevational view of an expansible wall unit assembled from a series of interlocking modular wall elements.
Figure 30:
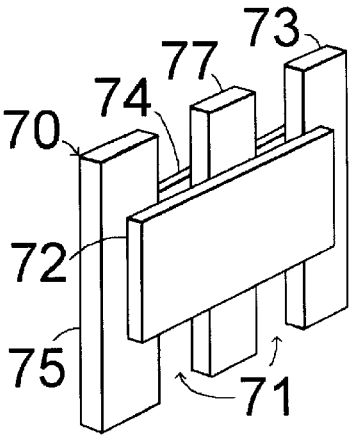
FIG. 30 is a perspective view of an interlocking modular triple tenon support.

In FIGS. 19, 23, and 30 an interlocking modular wall member 70 comprises a pair of wall panels 72 and 74 spaced apart in face-to-face parallel alignment and three interlocking elements 73, 77, and 75 of equal width and length sandwiched between the wall panels and spaced apart by a distance equal to the width of the interlocking elements forming mortise openings between the interlocking elements. A securing means, as used in the interlocking modular elements, connects the interlocking elements to the wall panels. The interlocking elements 73, 77, and 75 protrude beyond the wall panels 72 and 74 to form tenon protrusions. A series of interlocking modular wall members 70 interlock together with the tenon protrusions of one interlocking modular wall element inserted in the mortise openings of neighboring interlocking modular wall elements in an overlapping array with the wall panels in planar alignment, to form a vertical wall. Interlocking means connect the vertical wall with the vertical structural supports. In FIG. 23 an alternate interlocking modular wall member 70A has fewer interlocking elements to finish off the corner of the vertical wall evenly.

A method of making a modular structural system having interlocking members which may be assembled without tools and without connecting hardware comprises the steps of fabricating a series of interlocking modular elements 10 and 20 having interlocking connections therebetween interconnectable to form a vertical support structure, by spacing apart a pair of flat side panels 12 & 14 and 21 & 23 in a face-to-face parallel alignment, sandwiching between the side panels a pair of flat elongated elements 13 & 15 and 23 & 25 longer than the side panels, spacing apart the elongated elements in a planar side-by-side alignment creating a vertical slot 11 and 21 therebetween, the elongated elements extending out beyond the top and the bottom of the side panels creating a top vertical slot and a bottom vertical slot each equal in width to the outside distance between the side panels, securing the side panels and the elongated elements together by a securing means, and interconnecting the interlocking modular elements one with another by vertically stacking them in an alternating orthogonal arrangement (as in FIGS. 21, 29, and 31), engaging each vertical slot with the vertical slot and the side panels of the adjacent interlocking modular element to form a vertical structural support, at least a portion of which, is formed by orthogonally intersecting interlocking modular elements; fabricating a series of horizontal elements, each having at each end a means for engaging a side panel of the vertical structural support, spacing apart two vertical structural supports and supporting a series of horizontal elements therebetween by positioning the horizontal elements adjustably on desired side panels.

The method above further comprising the step of forming each of the modular elements as a self-interlocking modular element 10 having at least two equal elongated elements 13 and 15 sandwiched between the side panels 12 and 14 and spaced apart by the width of one of the elongated elements to form the vertical slot therebetween, the portion of the vertical slot between the side panels forming a mortice, a portion of each of the elongated elements protruding above the side panels and a portion protruding below the side panels, the protruding portions forming top and bottom tenons of one self-interlocking modular element, and inserting each tenon in the mortice of an adjacent self-interlocking modular element to form a rigid connection therebetween, with a series of interconnected self-interlocking modular elements forming a planar vertical structural support which may have different patterns by alternating which tenon is inserted in which mortice.

In FIGS. 29 and 31, a method of making a modular structural system comprises the steps of fabricating a series of interlocking modular elements 20 by spacing apart a pair of flat side panels 22 and 24 in a face-to-face parallel alignment, sandwiching between the side panels a pair of flat elongated elements 23 and 25 longer than the side panels, spacing apart the elongated elements in a planar side-by-side alignment creating a vertical slot 21 therebetween, the elongated elements extending out beyond the top and the bottom of the side panels creating a top edge slot and a bottom edge slot each equal in width to the outside distance between the side panels, securing the side panels and the elongated elements together by a securing means as discussed above, and interconnecting the interlocking modular elements one with another by vertically stacking them in an alternating orthogonal arrangement, engaging each edge slot with the edge slot and the side panels of the adjacent interlocking modular element to form a first vertical structural support 86, at least a portion of which, is formed by orthogonally intersecting interlocking modular elements, as seen on the left side of FIG. 31. And further comprising fabricating a series of second horizontal elements 30, each having at each end a means for engaging a side panel of the first vertical structural support, spacing apart two first vertical structural supports and supporting a series of second horizontal elements therebetween by positioning the second horizontal elements adjustably on desired side panels.

In FIGS. 25–28, the method further comprises the steps of fabricating the vertical slot 21 to extend along the entire length of the elongated elements creating a mortise opening vertically through the interlocking modular elements 20, and fabricating a series of second modular elements 40 by spacing apart a pair of flat second side panels 42 and 44 in a face-to-face parallel alignment and sandwiching an upper and lower tenon protrusion between the second side panels, attaching the upper and lower tenon protrusions thereto by a securing means such as those mentioned above, the tenon protrusions extending above and below the second side panels, each tenon protrusion sized to fit in the mortise opening, stacking the interlocking modular elements and second modular elements alternating an interlocking modular element and a second modular element with the side panels all aligned in a coplanar configuration, engaging the tenons of the second modular elements with the mortises of the interlocking modular elements to form a first vertical structural support, at least a portion of which, is formed by coplanar aligned interlocking modular elements as seen in FIG. 28.

The method further comprises the step of sandwiching a single central post 41 between the second side panels 42 and 44 of the second modular elements and rigidly attaching the central post to both of the second side panels to form the upper and lower tenon protrusion of each second modular element, the central post extending higher and lower than the second side panels forming a tenon protrusion extending above and below the second side panels and through the space between the second side panels, the central post equal in thickness to the thickness of the elongated elements and equal in width to the space between the side panels.

The method further comprises the step of forming each of the elongated elements 23 and 25 to be equal in vertical length to the vertical length of each of the central posts 41 and stacking the interlocking modular elements so that the elongated elements of one interlocking modular element contact the elongated elements of the next neighboring interlocking modular element and the central post of one second modular element contacts the central post of the next neighboring second modular element in the first alternate vertical structural support as seen in FIG. 26.

The method further comprises the step of fabricating each of the side panels 22 and 24 and each of the second side panels 42 and 44 to be equal in vertical length to less than half of the vertical length of each of the elongated elements 23 and 25 and to less than half of the vertical length of each of the central posts 41, and stacking the interlocking modular elements so that, in the first alternate vertical structural support 86, each of the adjacent side panels are spaced apart leaving a horizontal slot 29 therebetween as seen in FIG. 28.

In FIG. 27, the method further comprises forming each of the second horizontal elements 30 by spacing apart two horizontal planar members 36 in planar alignment and interconnecting them by rigidly attaching a single reinforcing element 38 to both horizontal planar members on an underside of the horizontal planar members to form a rigid second horizontal element with an open slot at each end, and inserting each end of the second horizontal element reversibly in one of the horizontal slots 29 formed between the panels.

The planar members may be fabricated from cut wood or formed plastic or metal or cement or a composite or other rigid material and may be finished by painting or other means before assembling them to form the elements of the system.

It is understood that the preceding description is given merely by way of illustration and not in limitation of the invention and that various modifications may be made thereto without departing from the spirit of the invention as claimed.

What is claimed is:

1. A modular structural system having interlocking members which may be assembled without tools and without connecting hardware, the system comprising:

a series of interlocking modular elements having interlocking connections therebetween interconnectable to form a vertical support structure, each interlocking modular element having a pair of flat side panels spaced apart in a face-to-face parallel alignment and at least two longer elongated elements spaced apart to create a vertical slot and sandwiched between the side panels and attached thereto by an attaching means, the elongated elements spaced apart a sufficient distance to accommodate the side panels of an adjacent modular element slidably therebetween with the adjacent modular element positioned orthogonally, each of the interlocking modular elements structured with the elongated elements protruding beyond the side panels a sufficient length so that the elongated elements of each alternating interlocking modular element are capable of contacting the elongated elements of each other alternating interlocking modular element and the side panels of each interlocking modular element are sufficiently shorter than the elongated elements so that they are not capable of contacting the side panels of each adjacent interlocking modular element, so that when the interlocking modular elements are interconnected in the vertical support structure a series of horizontal slots is formed between the side panels of the adjacent interlocked modular elements;

a top and a bottom horizontal tie member each having two ends each removably interconnectable to a vertical support structure by a rigid connecting means so that the horizontal tie members rigidly interconnect a pair of vertical support structures in a spaced relationship;

a series of horizontal elements, each having at each end a means for engaging one of the horizontal slots in the vertical support structure;

wherein two spaced apart vertical support structures support a series of horizontal elements therebetween, the horizontal elements positioned adjustably in selected horizontal slots.

2. The system of claim 1 wherein each of the modular elements comprises a self-interlocking modular element having at least two equal elongated elements sandwiched between the side panels and spaced apart by the width of one of the elongated elements to form the vertical slot therebetween, the portion of the vertical slot between the side panels forming a mortice, a portion of each of the elongated elements protruding above the side panels and a portion protruding below the side panels, the protruding portions forming top and bottom tenons of one self-interlocking modular element, each tenon insertable in the mortice of an adjacent self-interlocking modular element to form a rigid connection therebetween, with a series of interconnected self-interlocking modular elements forming a planar vertical structural support which may have different patterns by alternating which tenon is inserted in the mortice.

3. The system of claim 2 wherein each self-interlocking modular element has at least three elongated elements forming three protruding top tenons and three protruding bottom tenons with two mortises therebetween to form a wider planar vertical structural support and thereby increase the number of patterns formed by alternating which tenon is inserted in which mortice.

4. The system of claim 2 wherein each of the side panels is equal in vertical length to less than half of the vertical length of each of the elongated members so that, in the vertical support formed of the series of vertically connected self-interlocking modular elements, the tenons of alternate self-interlocking modular elements contact each other in the mortice of the intermediate self-interlocking modular element leaving each of the adjacent side panels spaced apart providing two of the series of horizontal slots.

5. The system of claim 4 wherein each of the horizontal elements comprises an elongated planar member slightly thinner than each of the horizontal slots and having a bottom edge slot in the bottom edge of each end equal in length to the horizontal length of each of the side panels, forming a first horizontal element so that each end of the first horizontal element is removably insertable in any of the horizontal slots formed between the side panels and each end of each of the first horizontal elements engages a side panel in the bottom edge slot.

6. The system of claim 5 wherein each side edge of each of the side panels is provided with an edge groove and further comprising a horizontal tie member having an elongated rigid horizontal body equal in length to the first horizontal elements and a pair of spaced vertical components at each end, each of the vertical components being provided with a means to engage the edge groove of the side panels so that the horizontal tie member is connectable between two vertical structural supports to hold them rigidly together and between a series of vertical structural supports for expanding the modular structural system.

7. The system of claim 6 wherein the horizontal tie member further comprises a vertical back member having an opening at each end and a top horizontal tie member connects the two spaced vertical components at their top ends and a bottom horizontal tie member connects the spaced vertical components at their bottom ends, and further comprising an elongated brace having protrusions at each end so that one protrusion fits into an opening in the top horizontal tie member adjacent to one vertical component and the other protrusion fits into an opening in the bottom horizontal tie member adjacent to the other vertical component creating a diagonal brace across the back of the assembled modular structural system.

8. The system of claim 5 further comprising a storage element having at least one storage space formed by a bottom surface and vertical walls extending upwardly therefrom and having slot engaging ridges protruding from each end to slidably engage the horizontal slots of the vertical structural supports.

9. The system of claim 1 wherein the vertical slot extends along the entire length of the elongated elements creating a mortise opening vertically through the interlocking modular elements, and further comprising a series of second modular elements, each second modular element having a pair of flat second side panels spaced apart in a face-to-face parallel alignment and a single central post sandwiched between the second side panels and rigidly attached to each of the second side panels, the central post extending higher and lower than the second side panels forming a tenon protrusion extending above and below the second side panels, each tenon protrusion sized to fit in the mortise opening, so that by stacking the interlocking modular elements and the second modular elements, alternating an interlocking modular element and a second modular element with the side panels all aligned in a coplanar configuration, the tenons of the second modular elements engage the mortises of the interlocking modular elements forming a second vertical structural support at least a portion of which is formed by coplanar aligned interlocking modular elements and second modular elements.

10. The system of claim 9 wherein each of the elongated elements is equal in vertical length to the vertical length of each of the central posts so that the elongated elements of one interlocking modular element contact the elongated elements of the next neighboring interlocking modular element and the central post of one second modular element contacts the central post of the next neighboring second modular element in the second vertical structural support; wherein each of the side panels is equal in vertical length to less than half of the vertical length of each of the elongated elements and to less than half of the vertical length of each of the central posts, so that, in the second vertical structural support, each of the adjacent side panels are spaced apart leaving a horizontal slot therebetween.

11. The system of claim 10 wherein each of the horizontal elements comprises two elongated planar horizontal members spaced apart in planar alignment and a single reinforcing element interconnecting the elongated planar horizontal members, the reinforcing element rigidly attached to both elongated planar horizontal members on an underside of the elongated planar horizontal members, forming a rigid second horizontal element with an open slot at each end, so that each end of the second horizontal element is reversibly insertable in the horizontal slot formed between the panels.

12. The system of claim 11 further comprising a securing means insertable in the open slot of the second horizontal element to secure the second horizontal element to the vertical structural support.

13. The system of claim 10 further comprising a tie for connecting vertical structural supports comprising an elongated first tie member having at least a portion of an interlocking modular element secured in planar alignment with the first tie member at each end thereof so that each end interlocking modular element interlocks into each first vertical structural support.

14. The system of claim 13 wherein the end interlocking modular elements, at one end, are interlocked into one vertical structural support orthogonally to a first plane formed by the vertical structural supports and the second horizontal elements, and the end interlocking modular elements, at the other end, are interlocked into a separate vertical structural support forming, along with the one vertical structural support and a separate series of second horizontal elements, a second plane orthogonal to the first plane.

15. The system of claim 14 further comprising a tie for connecting vertical structural supports comprising a second elongated tie member having at least a portion of a second modular element secured orthogonally to the second tie member at each end thereof so that each end second modular element interlocks into each second vertical structural support.

16. The system of claim 15 further comprising a series of interlocking modular wall members each comprising a pair of wall panels spaced apart in face-to-face parallel alignment and three interlocking elements of equal width and length sandwiched between the wall panels and spaced apart by a distance equal to the width of the interlocking elements forming mortise openings between the interlocking elements, and a securing means connecting the interlocking elements to the wall panels, the interlocking elements protruding beyond the wall panels to form tenon protrusions, so that the series of interlocking modular wall members interlock together with the tenon protrusions of one interlocking modular wall element are inserted in the mortise openings of neighboring interlocking modular wall elements in an overlapping array with the wall panels in planar alignment, to form a vertical wall and interlocking means connecting the vertical wall with the vertical structural supports.

17. The system of claim 1 wherein the top and bottom horizontal tie members each comprises an adjustable horizontal tie shelf having an elongated horizontal shelf surface and having an adjustable means at each of the two ends for rigidly engaging at least one of the interlocking modular elements of the vertical support structure.

18. The system of claim 1 further comprising a lattice brace having large scissor-type pivotable connections formed by large pivot members connected at each end and in the center by pivot joints and having a top end of the lattice brace terminating in a center pivot joint of the top pivot members which are half the length the of the other large pivot members and having a bottom end of the lattice brace terminating at two bottom ends of a pair of bottom large pivot members and having the top center pivot joint of the lattice brace connected to the top horizontal tie member at the horizontal tie member center point and the bottom ends of the lattice brace slidably connected to the bottom horizontal tie member, the lattice brace being adjustable to any desired height depending on the height of the structure.

19. A method of making a modular structural system having interlocking members which may be assembled without tools and without connecting hardware comprising the steps of:

fabricating a series of interlocking modular elements having interlocking connections therebetween interconnectable to form a vertical support structure, by spacing apart a pair of flat side panels in a face-to-face parallel alignment, sandwiching between the side panels a pair of flat elongated elements longer than the side panels, spacing apart the elongated elements in a planar side-by-side alignment creating a vertical slot therebetween, the elongated elements extending out beyond the top and the bottom of the side panels creating a top vertical slot and a bottom vertical slot each equal in width to the outside distance between the side panels, securing the side panels and the elongated elements together by a securing means, each of the interlocking modular elements structured with the elongated elements protruding beyond the side panels a sufficient length so that the elongated elements of each alternating interlocking modular element are capable of contacting the elongated elements of each other alternating interlocking modular element and the side panels of each interlocking modular element are sufficiently shorter than the elongated elements so that they are not capable of contacting the side panels of each adjacent interlocking modular element, so that when the interlocking modular elements are interconnected in the vertical support structure a series of horizontal slots is formed between the side panels of the adjacent interlocked modular elements, and interconnecting the interlocking modular elements one with another by vertically stacking them in an alternating orthogonal arrangement, engaging each vertical slot with the vertical slot and the side panels of the adjacent interlocking modular element to form a vertical structural support, at least a portion of which, is formed by orthogonally intersecting interlocking modular elements;

fabricating a top and a bottom horizontal tie member each having two ends each removably interconnectable to a vertical support structure by a rigid connecting means and rigidly interconnecting a pair of vertical support structures in a spaced relationship by the horizontal tie members;

fabricating a series of horizontal elements, each having at each end a means for engaging a side panel of the vertical structural support in one of the horizontal slots;

spacing apart two vertical structural supports and supporting a series of horizontal elements therebetween by positioning the horizontal elements adjustably on desired side panels in desired horizontal slots.

20. The method of claim 19 further comprising the step of forming each of the modular elements as a self-interlocking modular element having at least two equal elongated elements sandwiched between the side panels and spaced apart by the width of one of the elongated elements to form the vertical slot therebetween, the portion of the vertical slot between the side panels forming a mortice, a portion of each of the elongated elements protruding above the side panels and a portion protruding below the side panels, the protruding portions forming top and bottom tenons of one self-interlocking modular element, and inserting each tenon in the mortice of an adjacent self-interlocking modular element to form a rigid connection therebetween, with a series of interconnected self-interlocking modular elements forming a planar vertical structural support which may have different patterns by alternating which tenon is inserted in which mortice.

21. The method of claim 19 further comprising the steps of fabricating the vertical slot to extend along the entire length of the elongated elements creating a mortise opening vertically through the interlocking modular elements, and fabricating a series of second modular elements by spacing apart a pair of flat second side panels in a face-to-face parallel alignment and sandwiching an upper and lower tenon protrusion between the second side panels, attaching the upper and lower tenon protrusions thereto by a securing means, the tenon protrusions extending above and below the second side panels, each tenon protrusion sized to fit in the mortise opening, stacking the interlocking modular elements and second modular elements alternating a first and a second with the side panels all aligned in a coplanar configuration, engaging the tenons of the second modular elements with the mortises of the interlocking modular elements to form a second vertical structural support, at least a portion of which, is formed by coplanar aligned interlocking modular elements.

* * * * *